US010174409B2

(12) United States Patent
Yan et al.

(10) Patent No.: US 10,174,409 B2
(45) Date of Patent: Jan. 8, 2019

(54) HIGH PERFORMANCE ALSIMGCU CASTING ALLOY

(71) Applicant: ALCOA INC., Pittsburgh, PA (US)

(72) Inventors: Xinyan Yan, Murrysville, PA (US); Jen C. Lin, Export, PA (US)

(73) Assignee: ALCOA USA CORP., Pittsburgh, PA (US)

( * ) Notice: Subject to any disclaimer, the term of this patent is extended or adjusted under 35 U.S.C. 154(b) by 0 days.

(21) Appl. No.: 13/662,132

(22) Filed: Oct. 26, 2012

(65) Prior Publication Data

US 2013/0105045 A1 May 2, 2013

Related U.S. Application Data

(60) Provisional application No. 61/628,321, filed on Oct. 28, 2011, provisional application No. 61/628,320, filed on Oct. 28, 2011.

(51) Int. Cl.

| | |
|---|---|
| ***C22F 1/043*** | (2006.01) |
| ***C22C 21/02*** | (2006.01) |
| ***C22C 21/04*** | (2006.01) |

(52) U.S. Cl.

CPC ..... *C22C 21/04* (2013.01); *C22C 21/02* (2013.01); *C22F 1/043* (2013.01)

(58) Field of Classification Search

CPC ..... C22C 21/02; C22C 21/04; C22C 21/12; C22C 21/14; C22C 21/16; C22F 1/043; C22F 1/057

USPC ..... 148/95, 439

See application file for complete search history.

(56) References Cited

U.S. PATENT DOCUMENTS

| | | | | |
|---|---|---|---|---|
| 2,821,495 | A | 1/1958 | Dulin | |
| 5,846,347 | A | 12/1998 | Tanaka et al. | |
| 5,879,478 | A | 3/1999 | Loue et al. | |
| 6,630,039 | B2 * | 10/2003 | Lukasak et al. | 148/690 |
| 7,625,454 | B2 | 12/2009 | Lin et al. | |

(Continued)

FOREIGN PATENT DOCUMENTS

| | | | |
|---|---|---|---|
| DE | 19524564 | 1/1997 | |
| DE | 19524564 A1 * | 1/1997 | C22C 21/02 |

(Continued)

OTHER PUBLICATIONS

International Search Report and Written Opinion, dated Jul. 31, 2013, from related International Application No. PCT/US2012/062250.

(Continued)

*Primary Examiner* — Daniel McCracken

(74) *Attorney, Agent, or Firm* — Greenberg Traurig, LLP

(57) ABSTRACT

An aluminum casting alloy has 8.5-9.5 wt. % silicon, 0.5-2.0 wt. % copper (Cu), 0.27-0.53 wt. % magnesium (Mg), wherein the aluminum casting alloy includes copper and magnesium such that 4.7≤(Cu+10Mg)≤5.8, and other elements, the balance being aluminum. Selected elements may be added to the base composition to give resistance to degradation of tensile properties due to exposure to heat. The thermal treatment of the alloy is calculated based upon wt. % composition to solutionize unwanted phases having a negative impact on properties and may include a three level ramp-up and soak to a final temperature followed by cold water quenching and artificial aging.

10 Claims, 35 Drawing Sheets

(a) (b)

(56) References Cited

U.S. PATENT DOCUMENTS

| | | | | |
|---|---|---|---|---|
| 8,574,382 | B2 | 11/2013 | Dragulin et al. | |
| 2003/0143102 | A1* | 7/2003 | Matsuoka et al. | 420/546 |
| 2003/0155049 | A1 | 8/2003 | Bergsma | |
| 2004/0045638 | A1 | 3/2004 | Garat et al. | |
| 2004/0261615 | A1* | 12/2004 | Yanagimoto et al. | 92/208 |
| 2005/0199318 | A1* | 9/2005 | Doty | 148/439 |
| 2009/0260724 | A1* | 10/2009 | Pandey | 148/550 |
| 2010/0006192 | A1 | 1/2010 | Okamoto | 148/691 |
| 2010/0047113 | A1 | 2/2010 | Lin et al. | |
| 2012/0000578 | A1* | 1/2012 | Wang | C22C 21/02 148/549 |

FOREIGN PATENT DOCUMENTS

| | | | | | |
|---|---|---|---|---|---|
| JP | 56163234 | A | | 12/1981 | |
| JP | H02-061025 | | * | 3/1990 | |
| JP | 05179383 | A | * | 7/1993 | C22C 21/02 |
| JP | 2001073056 | | | 3/2001 | |
| JP | 2001262262 | A | | 9/2001 | |
| JP | 200247526 | | | 2/2002 | |
| JP | 2007048643 | A | | 2/2007 | |
| JP | 20080035030 | | | 2/2008 | |
| JP | 2009127122 | A | * | 6/2009 | |
| JP | 2010-053743 | | | 3/2010 | |
| JP | 2010158771 | A | | 7/2010 | |
| WO | 0071772 | A1 | | 11/2000 | |
| WO | 2005075692 | A1 | | 8/2005 | |
| WO | 2006014948 | | | 9/2006 | |

OTHER PUBLICATIONS

Chen, S. L., et al., "The PANDAT Software package and its applications," *CALPHAL*, 26(2): 175-188, Jun. 1, 2002, XP055072399.

Chen, S. L., et al., "Calculating phase diagrams using PANDAT and panengine," *JOM*, 55(12): 48-51, Dec. 1, 2003, XP055072400.

Kraft, T., et al., "Predicting microstructure and microsegregation in multicomponent alloys," *JOM*, 49(12): 20-28, Dec. 1, 1997, XP055072397.

Lumley, R. N., et al., "Rapid Heat Treatment of Aluminum High-Pressure Diecastings," *Metallurgical and Materials Transactions A*, 40(7): 1716-1726, Springer Verlag, New York, May 2, 2009, XP019696606.

Sunday, S., et al., "A Study of the Mechanical Properties of Cast-to-Wrought Aluminium Welds," Welding Research Supplement, Feb. 1, 1984, retrieved from the Internet on May 3, 2013, XP055061759.

Yan, X., et al., "Computational and experimental investigation of microsegregation in an Al-rich Al—Cu—Mg—Si quaternary alloy," *Acta Materiala*, 50(9):2199-2207, May 1, 2002, XP055072398.

ASM Handbook, Formerly 9th Edition, Metals Handbook vol. 15, Casting. Copyright 1988 ASM International, ISBN 0-87170-007-7 (v. 1) pp. 332-334; 744-746; 754; 757-759; 767.

International Standard, ISO 3522 Aluminum and aluminum alloys—Castings—Chemical composition and mechanical properties, Third Edition May 1, 2006, 28 pages.

ASM Material Data Sheet, ASM Aerospace Specification Metals Inc. http://asm.matweb.com/search/Specific.Material.asp?bassnum=MA7075T6 Feb. 26, 2014, 2 pages.

Alcoa Mill Products, Alloy 7075 Plate and Sheet All Around Consistent Performance, 4 pages.

7075 Aluminum alloy—Wikipedia, the free encyclopedia—http://en.wikipedia.org/wiki/7075_aluminum_alloy Feb. 26, 2014, 4 pages.

Chinese Office Action, dated Aug. 17, 2015, from corresponding Chinese Patent Application No. CN201280056407.5.

Technical specification sheet for aluminum, SG—AlSi9Cul/Ziar, document ID: EUR-SCM-XA-0034, by Nemak, Monterrey, Mexico, 2009.

Teksid Aluminum "Specifica composizione chimica leghe di alluminio", Documento Del Sistema Qualita No. DLEGAD05, 4 pages, Aug. 28, 2007.

Department of Defense Handbook MIL-HDBK-5J "Metallic Materials and Elements for Aerospace Vehicle Structures", pp. 3-496-3-497, Jan. 31, 2003.

eFunda: Properties of Aluminum Alloy 354.0, Ornamental Accessories, retrieved from the Internet at http://www.efunda.com/materials/alloys/aluminum/show_aluminum.cfm?ID=AA_354.0&show_prop=all&Page_title=354.0 on Oct. 9, 2014, pp. 1-2.

Sunday, S., et al., "A Study of the Mechanical Properties of Cast-to-Wrought Aluminium Welds," Welding Research Supplement, Feb. 1, 1984.

ASM Specialty Handbook: Aluminum and Aluminum Alloys, "Foundry Products" pp. 88-120, J.R. Davis Ed., 1993, ASM International, Materials Park, OH.

Metals Handbook, "Properties of Aluminum Casting Alloys", pp. 838-839, 1948, Taylor Lyman Ed., The American Society for Metals, Cleveland, OH.

Registration Record Series "Designations and Chemical composition Limits for Aluminum Alloys in the Form of Castings and Ingot", pp, 1-9, Apr. 2002, The Aluminum Association, Washington, DC.

Lumley, R. N., et al., "Heat Treatment of High-Pressure Die Castings", *Metallurgical and Materials Transactions A* 38A:2564-2574, Oct. 2007.

* cited by examiner

HIGH PERFORMANCE ALSIMGCU CASTING ALLOY

CROSS REFERENCE TO RELATED APPLICATIONS

This application claims the benefit of U.S. Provisional Application Nos. 61/628,320 and 61/628,321, both of which are incorporated herein by reference in their entireties.

FIELD

The present invention relates to aluminum alloys, and more particularly, to aluminum alloys used for making cast products.

BACKGROUND

Aluminum alloys are widely used, e.g., in the automotive and aerospace industries, due to a high performance-to-weight ratio, favorable corrosion resistance and other factors. Various aluminum alloys have been proposed in the past that have characteristic combinations of properties in terms of weight, strength, castability, resistance to corrosion, cost, etc. Improvements in alloys to exhibit an improved combination of properties, e.g., that render them more suitable for one or more applications, remain desirable.

SUMMARY

The disclosed subject matter relates to improved aluminum casting alloys (also known as foundry alloys) and methods for producing same. More specifically, the present application relates to an aluminum casting alloy having: 8.5-9.5 wt. % silicon, 0.5-2.0 wt. % copper (Cu), 0.27-0.53 wt. % magnesium (Mg), wherein the aluminum casting alloy includes copper and magnesium such that $4.7 \leq (Cu+10Mg) \leq 5.8$, up to 5.0 wt. % zinc, up to 1.0 wt. % silver, up to 0.30 wt. % titanium, up to 1.0 wt. % nickel, up to 1.0 wt. % hafnium, up to 1.0 wt. % manganese, up to 1.0 wt. % iron, up to 0.30 wt. % zirconium, up to 0.30 wt. % vanadium, up to 0.10 wt. % of one or more of strontium, sodium, antimony and calcium and other elements being ≤0.04 wt. % each and ≤0.12 wt. % in total, the balance being aluminum.

In one approach, the aluminum casting alloy includes 1.35-2.0 wt. % copper and 0.27-0.445 wt. % magnesium.

In one approach, the aluminum casting alloy includes 0.5-0.75 wt. % copper and 0.395-0.53 wt. % magnesium.

In one approach, the aluminum casting alloy includes 0.75-1.35 wt. % copper and 0.335-0.505 wt. % magnesium.

In one approach the aluminum casting alloy includes copper and magnesium such that $5.0 \leq (Cu+10Mg) \leq 5.5$.

In one approach, the aluminum casting alloy includes copper and magnesium such that $5.1 \leq (Cu+10Mg) \leq 5.4$.

In one approach, the aluminum casting alloy contains ≤0.25 wt. % zinc.

In one approach, the aluminum casting alloy contains 0.5 wt. to 5.0 wt. % zinc.

In one approach, the aluminum casting alloy contains ≤0.01 wt. silver.

In one approach, the aluminum casting alloy contains 0.05-1.0 wt. % silver.

In one approach, the aluminum casting alloy is subjected to a solution heat treatment at TH followed by a cold water quench, where TH (° C.)=570−10.48*Cu−71.6*Mg−1.3319*Cu*Mg−0.72*Cu*Cu+72.95*Mg*Mg, based on Mg and Cu content in wt %, within the range defined by a lower limit for TH:TQ=533.6−20.98*Cu+88.037*Mg+33.43*Cu*Mg−0.7763*Cu*Cu−126.267*Mg*Mg and an upper limit for TH:TS=579.2−10.48*Cu−71.6*Mg−1.3319*Cu*Mg−0.72*Cu*Cu+72.95*Mg*Mg.

In one approach, the casting aluminum casting alloy contains 0.1-0.12 wt. % titanium.

In one approach, the casting aluminum casting alloy contains 0.12-0.14 wt. % vanadium.

In one approach, the casting aluminum casting alloy contains 0.08-0.19 wt. % zirconium.

In one approach, the casting aluminum casting alloy contains 0.14-0.3 wt. % manganese.

In one approach, the casting aluminum casting alloy contains 0.15-0.57 wt. % iron.

In one approach, the casting aluminum casting alloy contains 0.1-0.12 wt. % vanadium.

In one approach, the casting aluminum casting alloy contains 0.11-0.13 wt. % zirconium.

In one approach, the casting aluminum casting alloy contains 0.27-0.3 wt. % nickel.

In one approach, the casting aluminum casting alloy contains 0.15-0.33 wt. % iron.

In one approach, the casting aluminum casting alloy contains 0.03-0.15 wt. % manganese.

In one approach, the casting aluminum casting alloy contains 0.05-0.2 wt. % hafnium.

In one approach, the casting aluminum casting alloy contains 0.1-0.12 wt. % vanadium.

In one approach, the casting aluminum casting alloy contains 0.012-0.04 wt. % zirconium.

In one approach, a method of selecting a solutionization temperature includes the steps of:

(A) Calculating the formation temperature of all dissolvable constituent phases in an aluminum alloy, and identifying a dissolvable constituent phase with the highest formation temperature;

(B) Calculating the equilibrium solidus temperature of an aluminum alloy;

(C) Defining a region in compositional space where the highest formation temperature of dissolvable constituent phases by at least 10° C. below the solidus temperature; and (D) Selecting a solutionization temperature within said defined region.

In one approach, the constituent phases are the phases formed during solidification.

In one approach, the identified steps A-D include:

(A) Calculating the formation temperatures of all dissolvable constituent phases comprised of Al, Cu, Mg and Si, and identify a dissolvable constituent phase with the highest formation temperature; and (B) Calculating the solidus temperature of an alloy comprised of Al, Cu, Mg, Si and all other alloying elements; and (C) Defining a region in Al—Cu—Mg—Si space where the highest formation temperature of dissolvable constituent phases is at least 10° C. below the solidus temperature; and (D) Selecting a solutionization temperature within said defined region.

In one approach, the dissolvable constituent phases are Q-AlCuMgSi, $Mg_2Si$, $Al_2Cu$, S—AlCuMg, etc. and the dissolvable constituent phase with the highest formation temperature is Q-AlCuMgSi phase in an Al Si Mg Cu alloy.

In one approach, the formation temperature of dissolvable constituent phases and solidus temperature are determined by computational thermodynamics.

In one approach, the formation temperature of dissolvable constituent phases and solidus temperature are calculated using Pandat™ Software and PanAluminum™ Database.

In one approach, an alloy is heat treated by heating the alloy above the formation temperature of all dissolvable constituent phases, but below the calculated solidus temperature.

In one approach, the alloy is an Al Si Mg Cu alloy and the dissolvable constituent phase with the highest formation temperature is Q-AlCuMgSi phase.

In one approach, a method for preparation of an alloy, includes the steps of:

(A) Identifying dissolvable constituent phases present in the alloy;

(B) Identifying a range of temperatures which promotes the solutionization of the dissolvable constituent phases during heat treatment;

(C) Allowing the alloy to solidify;

(D) Heating the solidified alloy to a temperature in the range identified in step (B) and below the solidus temperature of the alloy.

In one approach, a first elemental component and a second elemental component in their relative wt. % amounts in the alloy contribute to properties of the alloy as well as contribute to determining the formation temperature of all dissolvable constituent phases in the alloy and further comprising the steps of ascertaining a range of target properties for the alloy as effected by the first and second elemental components; ascertaining a range of relative wt % amounts for the first and second elemental components that provides the range of target properties prior to step (B) of identifying a range of temperatures.

In one approach, the first elemental component is Cu and the second elemental component is Mg in an Al Si Mg Cu alloy.

DETAILED DESCRIPTION OF EXEMPLARY EMBODIMENTS

EXAMPLE 1

Figure 1:
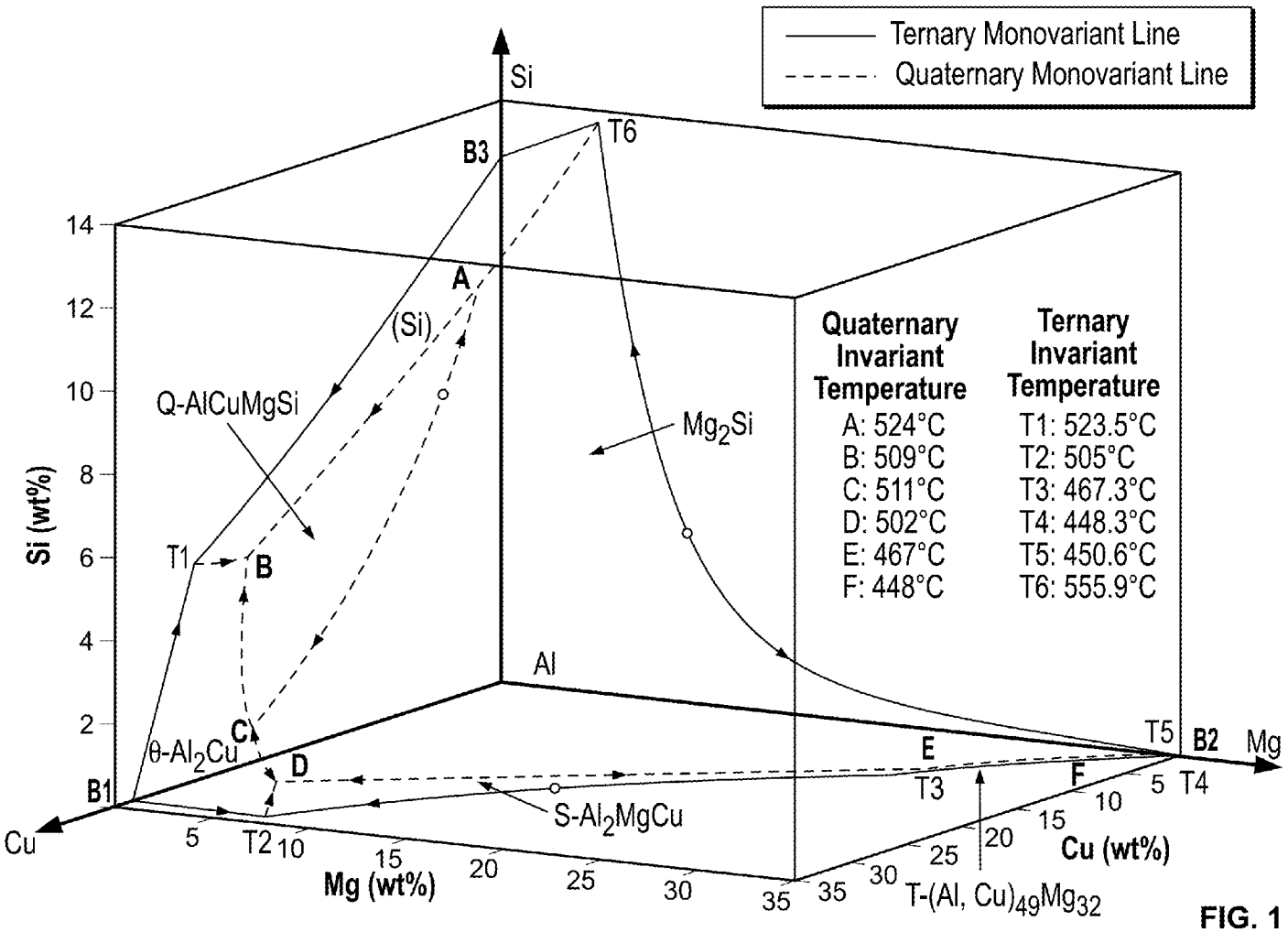
FIG. 1 is a graph of phase equilibria involving (Al) and liquid in an Al—Cu—Mg—Si system.

High Performance AlSiCuMg Cast Alloys 1.1 Alloy Development Methods Based on Computational Thermodynamics To improve the performances of Al—Si—Mg—Cu cast alloys, a novel alloy design method was used and is described as follows:

In Al—Si—Mg—Cu casting alloys, increasing Cu content can increase the strength due to higher amount of θ'-$Al_2Cu$ and Q' precipitates but reduce ductility, particularly if the amount of un-dissolved constituent Q-phase increases. FIG. 1 shows the calculated phase diagram of the Al—Cu—Mg—Si quaternary system, as shown in X. Yan, *Thermodynamic and solidification modeling coupled with experimental investigation of the multicomponent aluminum*

*alloys*. University of Wisconsin—Madison, 2001, which is incorporated in its entirety by reference herein. FIG. 1 shows the three phase equilibria in ternary systems and the four phase equilibria quaternary monovariant lines. Points A, B, C, D, E and F are five phase invariant points in the quaternary system. Points T1 to T6 are the four-phase invariant points in ternary systems and B1, B2 and B3 are the three phase invariant points in binary systems. The formation of Q-phase (AlCuMgSi) constituent particles during solidification is almost inevitable for an Al—Si—Mg alloy containing Cu since Q-phase is involved in the eutectic reaction (invariant reaction B). If these Cu-containing Q-phase particles cannot be dissolved during solution heat treatment, the strengthening effect of Cu will be reduced and the ductility of the casting will also suffer.

In order to minimize/eliminate un-dissolved Q-phase (AlCuMgSi) and maximize solid solution/precipitation strengthening, the alloy composition, solution heat treatment and aging practice should be optimized. In accordance with the present disclosure, a thermodynamic computation was used to select alloy composition (mainly Cu and Mg content) and solution heat treatment for avoiding un-dissolved Q-phase particles. Pandat thermodynamic simulation software and the PanAluminum database LLC, Computherm, Pandat Software and PanAluminum Database. http://www.computherm.com were used to calculate these thermodynamic data.

Figure 2:
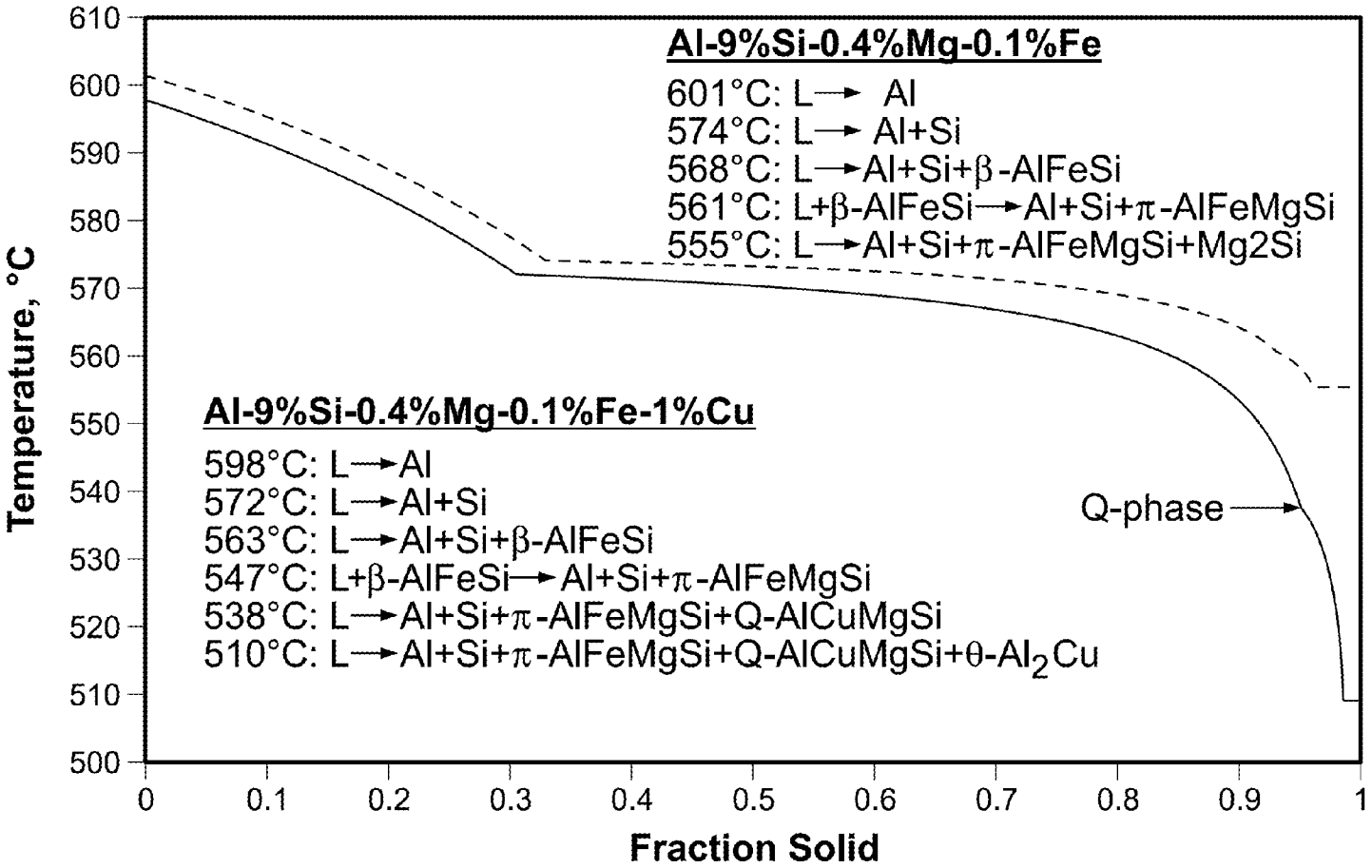
FIG. 2 is a graph of the effect of Cu additions on the solidification path of Al-9% Si-0.4% Mg-0.1% Fe alloy.

The inventors of the present disclosure recognize that adding Cu to Al—Si—Mg cast alloys will change the solidification sequence. FIG. 2 shows the predicted effect of 1% Cu (all compositions in this report are in weight percent) on the solidification path of Al-9% Si-0.4% Mg-0.1% Fe. More particularly, the solidification temperature range is significantly increased with the addition of 1% Cu due to the formation of Cu-containing phases at lower temperatures. For the Al-9% Si-0.4% Mg-0.1% Fe-1% Cu alloy, Q-AlCuMgSi formed at ~538° C. and θ-$Al_2Cu$ phase formed at ~510° C. The volume fraction of each constituent phase and their formation temperatures are also influenced by the Cu content.

Figure 3:
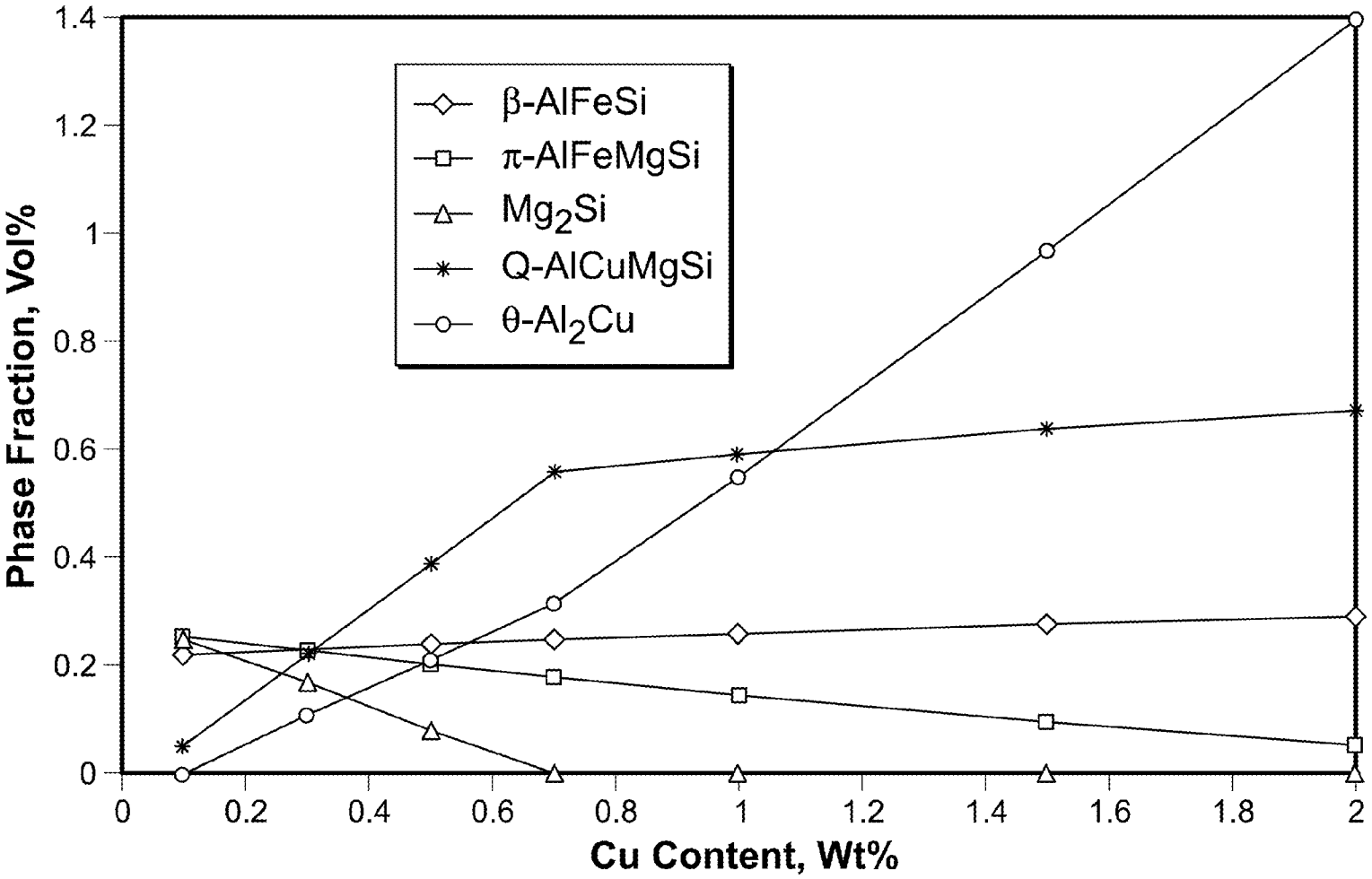
FIG. 3 is a graph of the effect of Cu content on phase fractions in Al-9%-0.4% Mg-0.1% Fe-x % Cu alloys.

FIG. 3 shows the predicted effect of Cu content on phase fractions in Al-9% Si-0.4% Mg-0.1% Fe-x % Cu alloys. As the Cu content increases, the amount of θ-$Al_2Cu$ and Q-AlCuMgSi increases while the amount of $Mg_2Si$ and π-AlFeMgSi decreases. In alloys with more than 0.7% Cu, $Mg_2Si$ phase will not form during solidification. The amount of Q-AlCuMgSi is also limited by the Mg content in the alloy if the Cu content is more than 0.7%.

Figure 4:
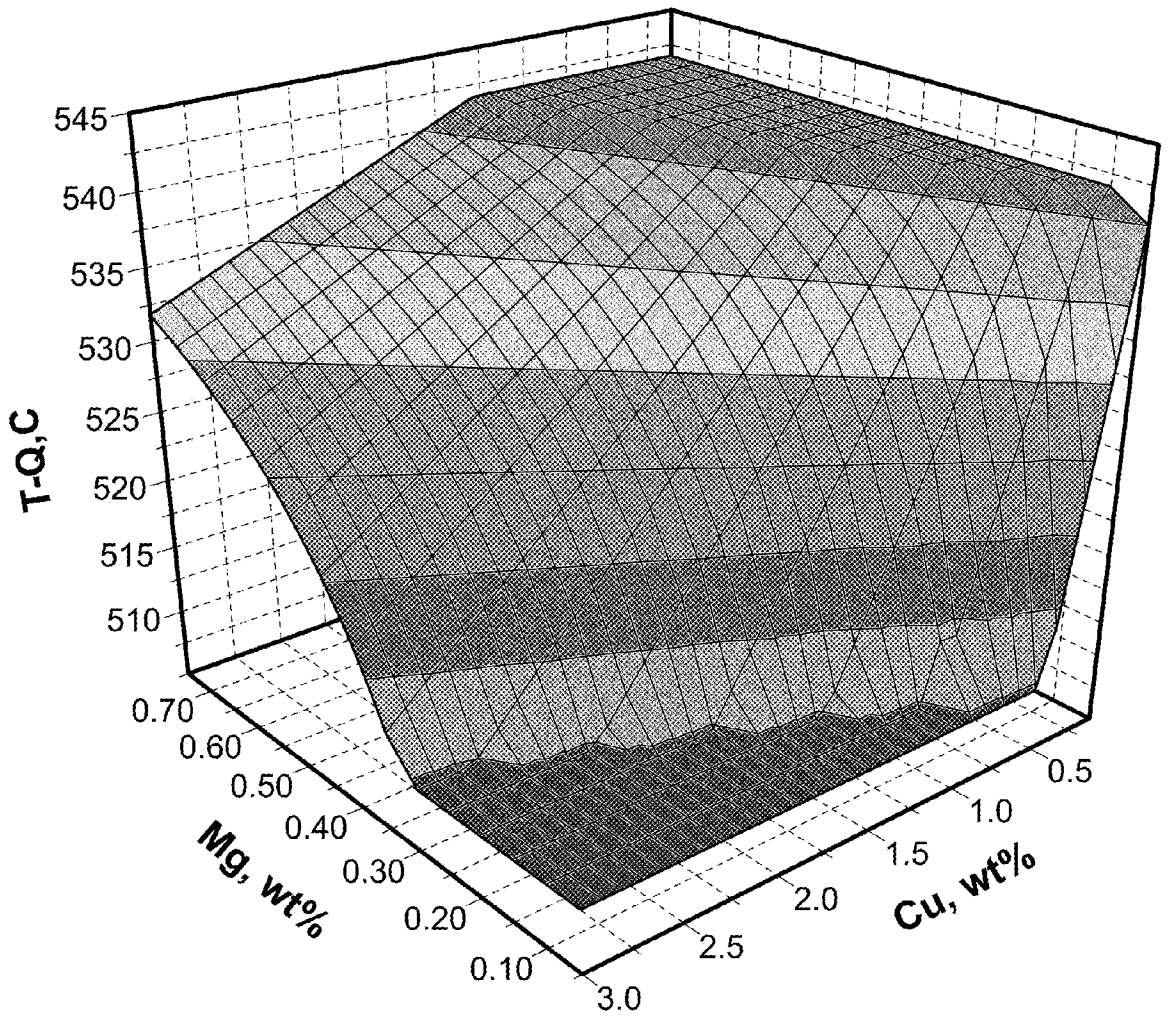
FIG. 4 is a graph of the effect of Cu and Mg content on the Q-phase formation temperature of Al-9% Si—Mg—Cu alloys.

The Q-AlCuMgSi phase formation temperature ($T_Q$) in Al-9% Si—Mg—Cu alloys is a function of Cu and Mg content. The "formation temperature" of a constituent phase is defined as the temperature at which the constituent phase starts to form from the liquid phase. FIG. 4 shows the predicted effects of Cu and Mg content on the formation temperature of Q-AlCuMgSi phase. The formation temperature of Q-AlCuMgSi phase decreases with increasing Cu content; but increases with increasing Mg content.

In accordance with the present disclosure, in order to completely dissolve all the as-cast Q-AlCuMgSi phase particles, the solution heat treatment temperature ($T_H$) needs to be controlled above the formation temperature of the Q-AlCuMgSi phase, i.e., $T_H>T_Q$. The upper limit of the solution heat treatment temperature is the equilibrium solidus temperature ($T_S$) in order to avoid re-melting. As a practical measure, the solution heat treatment temperature is controlled to be at least 5 to 10° C. below the solidus temperature to avoid localized melting and creation of metallurgical flaws known in the art as rosettes. Hence, in practice, the following relationship is established:

$$T_S-10^\circ\ C.>T_H>T_Q \quad (1)$$

Figure 5:
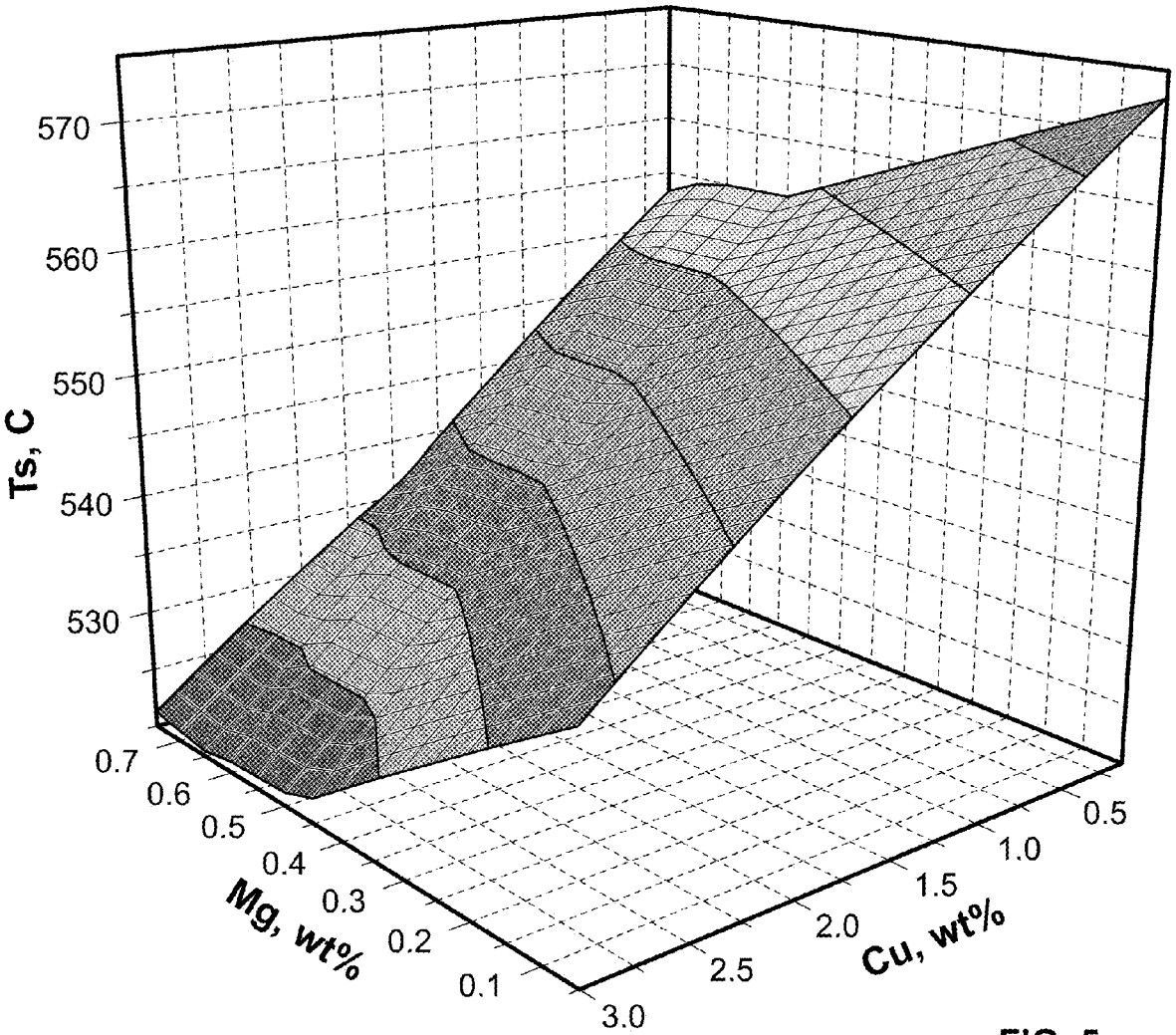
FIG. 5 is a graph of the effect of Mg and Cu content on the equilibrium solidus temperature of Al-9% Si—Mg—Cu alloys.
Figure 6:
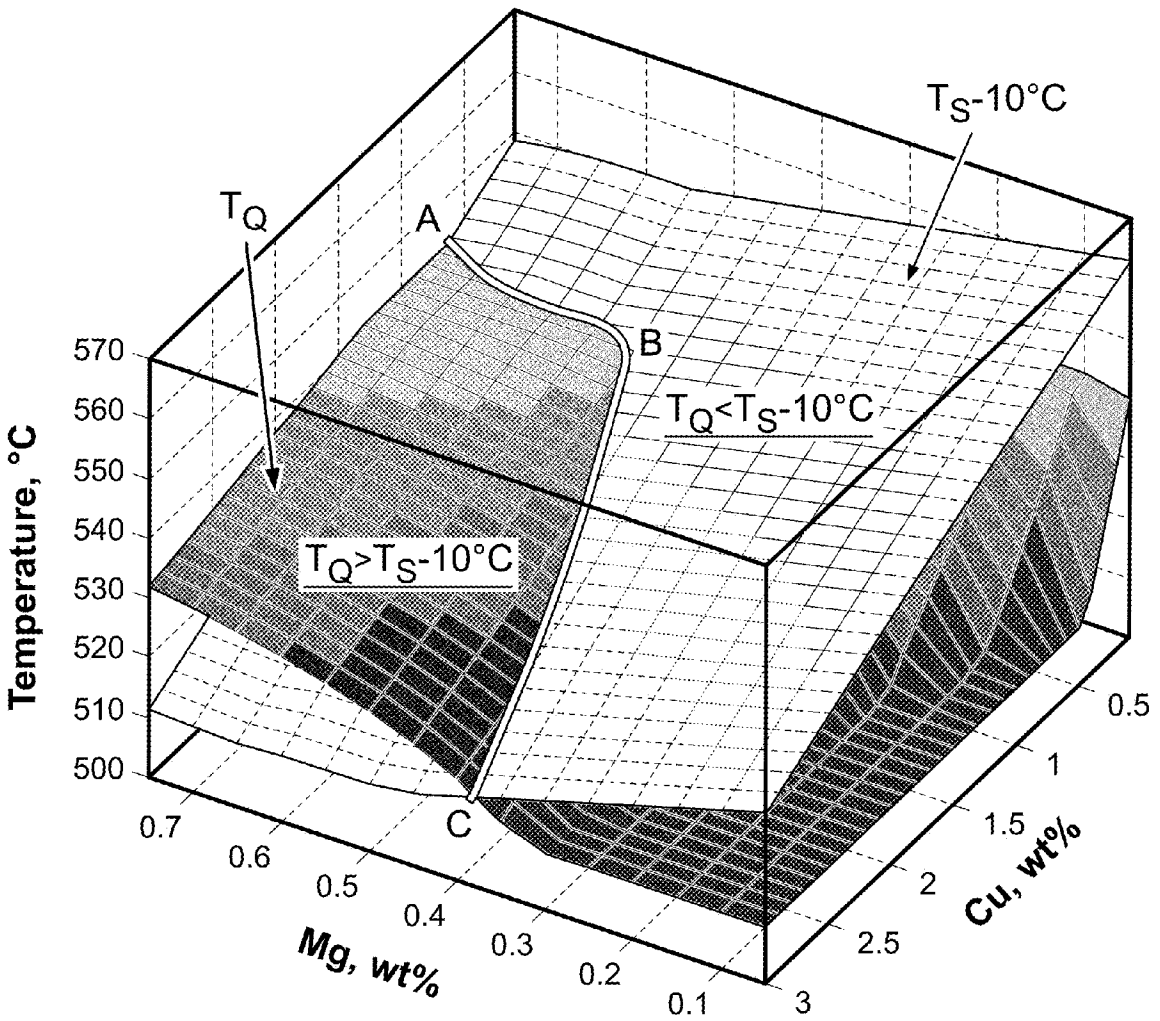
FIG. 6 is a graph of the effect of Mg and Cu content on the equilibrium solidus temperature ($T_S$) and Q-phase formation temperature ($T_Q$) of Al-9% Si—Mg—Cu alloys.
Figure 25:
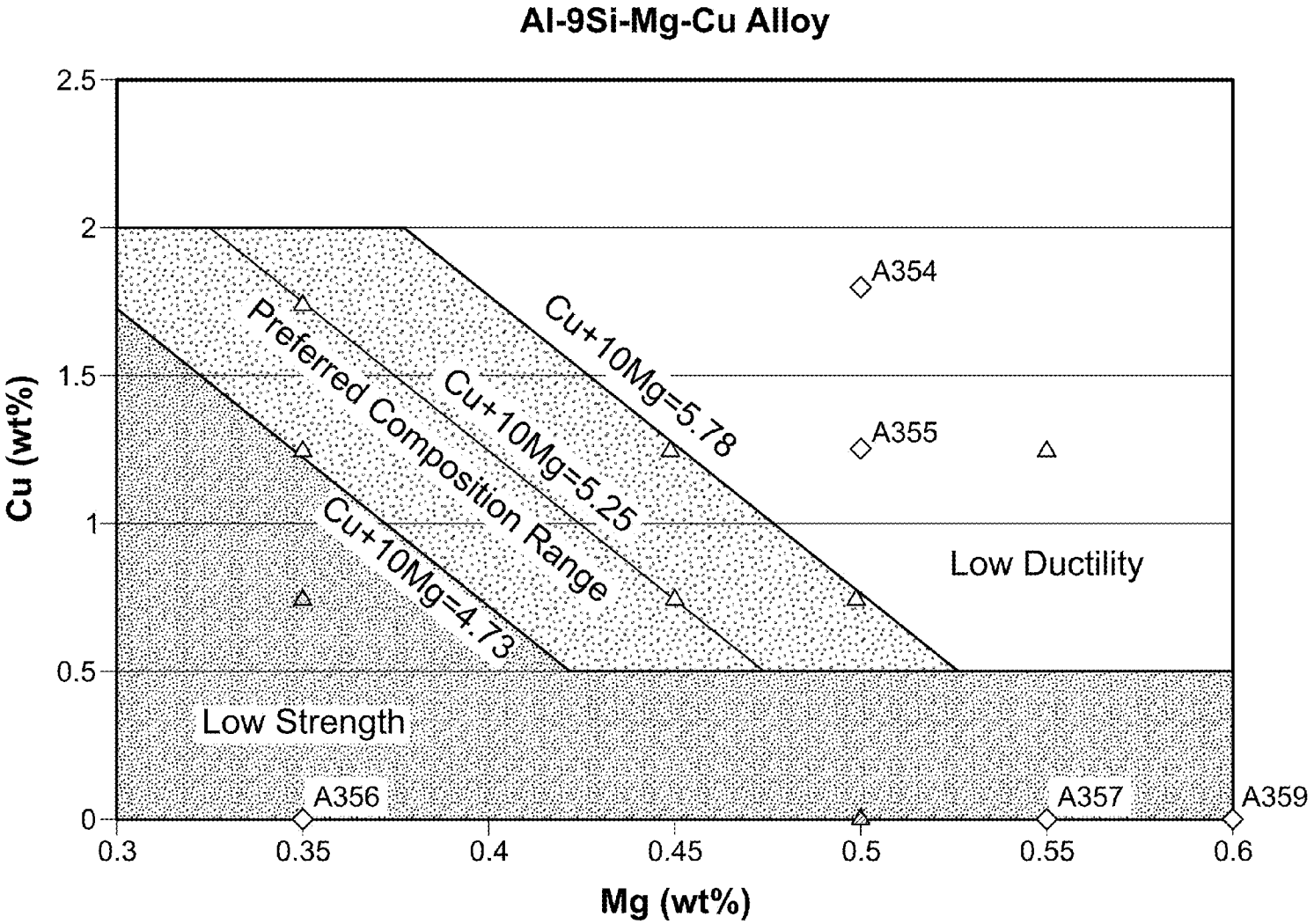
FIG. 25 is a graph of Mg and Cu content correlated to strength and ductility for Al-9Si—Mg—Cu alloys.

In accordance with the present disclosure, to achieve this criterion, the alloy composition, mainly the Cu and Mg contents, should be selected so that the formation temperature of Q-AlCuMgSi phase is lower than the solidus temperature. FIG. 5 shows the predicted effects of Cu and Mg content on the solidus temperature of Al-9% Si—Cu—Mg alloys. As expected, the solidus temperature decreases as the Cu and Mg content increases. It should be noted that Mg content increases the formation temperature of the Q-AlCuMgSi phase but decreases the solidus temperature as indicated in FIG. 6. The Q-AlCuMgSi phase formation temperature surface and the ($T_S$−10° C.) surface (10° C. below the solidus temperature surface) are superimposed in FIG. 6. These two surfaces intersect along the curve A-B-C. The area that meets the criterion of Equation (1) is on the right hand side of curve A-B-C, i.e., $T_Q<T_S-10^\circ$ C. Projection of the curve A-B-C to the Cu—Mg composition plane yields the center line Cu+10Mg=5.25 of the preferred composition boundary, as shown in FIG. 25. The lower boundary, Cu+10Mg=4.73, was defined by the intersection of the Q-AlCuMgSi phase formation temperature surface and the ($T_S$−15° C.) surface (15° C. below the solidus temperature surface). The upper boundary, Cu+10Mg=5.78, was defined by the intersection of the Q-AlCuMgSi phase formation temperature surface and the ($T_S$−5° C.) surface (5° C. below the solidus temperature surface). For Al-9% Si-0.1% Fe-x% Cu-y% Mg alloys, Q-AlCuMgSi phase particles can be completely dissolved during solution heat treatment when the Cu and Mg contents are controlled within these boundaries.

In accordance with the present disclosure, the preferred Mg and Cu content to maximize the alloy strength and ductility is shown in FIG. 25.

The preferred relationship of Mg and Cu content is defined by:

$$Cu+10Mg=5.25 \text{ with } 0.5<Cu<2.0.$$

The upper bound is Cu+10Mg=5.8 and the lower bound is Cu+10Mg=4.7.

The foregoing approach allows the selection of a solutionization temperature by (i) calculating the formation temperature of all dissolvable constituent phases in an aluminum alloy; (ii) calculating the equilibrium solidus temperature of an aluminum alloy; (iii) defining a region in Al—Cu—Mg—Si space where the formation temperature of all dissolvable constituent phases is at least 10° C. below the solidus temperature. The Al—Cu—Mg—Si space is defined by the relative % composition of each of Al, Cu, Mg and Si and the associated solidus temperatures for the range of relative composition. For a given class of alloy, e.g., Al—Cu—Mg—Si, the space may be defined by the solidus temperature associated with relative composition of two elements of interest, e.g., Cu and Mg, which are considered relative to their impact on the significant properties of the alloy, such as tensile properties. In addition, the solutionizing temperature may be selected to diminish the presence of specific phases, e.g., that have a negative impact on significant properties, such as, tensile properties. The alloy, e.g., after casting, may be heat treated by heating above the calculated formation temperature of the phase that needs to be completely dissolved after solution heat treatment, e.g., the Q-AlCuMgSi phase, but below the calculated equilibrium solidus temperature. The formation temperature of the phase that needs to be completely dissolved after solution heat treatment and solidus temperatures may be determined by computational thermodynamics, e.g., using Pandat™ software and PanAluminum™ Database available from CompuTherm LLC of Madison, Wis.

1.2 Composition Selection for Tensile Bar Casting

Figure 7:
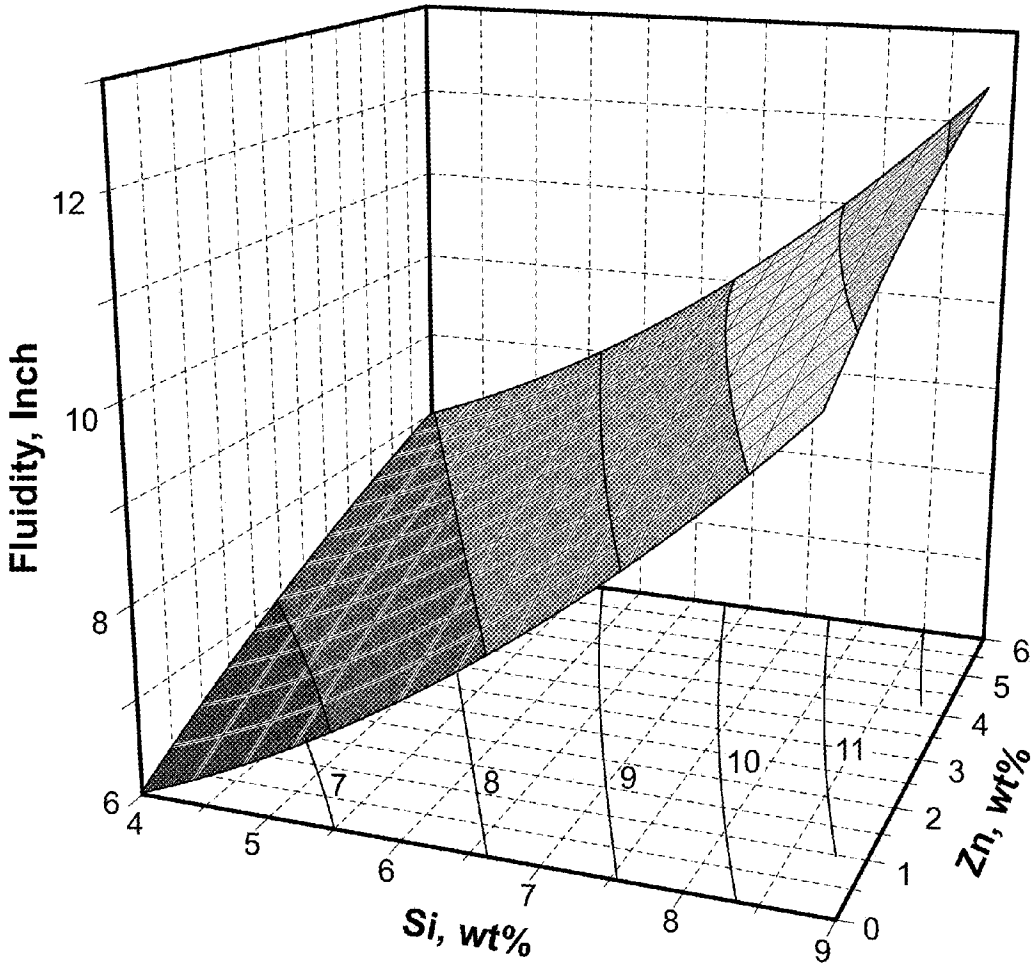
FIG. 7 is a graph of the effect of zinc and silicon on the fluidity of Al-x % Si-0.5% Mg-y % Zn alloys

Based on the foregoing analysis, several Mg and Cu content combinations were selected as given in Table 3. Additionally, studies by the present inventors have indicated that an addition of zinc with a concentration greater than 3 wt % to Al—Si—Mg—(Cu) alloys can increase both ductility and strength of the alloy. As shown in FIG. 7, zinc can also increase the fluidity of Al—Si—Mg alloys. Thus, an addition of zinc (4 wt %) was also evaluated. It has also been reported L. A. Angers, *Development of Advanced I/M 2xxx Alloys for High Speed Civil Transport Applications,* Alloy Technology Division Report No. AK92, 1990-04-16 that an addition of Ag can accelerate age-hardening of high Cu-containing (>~1.5 wt %) aluminum alloys, and increase the tensile strength at room temperature and elevated temperature. An addition of Ag (0.5 wt %) was also included in alloys with higher Cu content such as 1.75 wt % Cu. Hence, ten alloy compositions were selected for evaluation. The target compositions of these alloys are given in Table 3. It should be noted that alloy 1 in Table 3 is the baseline alloy, A359.

TABLE 3

Target Compositions

| | Alloy | Target Composition (wt %) | | | | | | | | |
|---|---|---|---|---|---|---|---|---|---|---|
| | | Si | Cu | Mg | Zn | Ag | Fe | Sr* | Ti | B |
| 1 | Al—9Si—0.5Mg | 9 | 0 | 0.5 | 0 | | <0.1 | 0.0125 | 0.04 | 0.003 |
| 2 | Al—9Si—0.35Mg—0.75Cu—4Zn | 9 | 0.75 | 0.35 | 4 | | <0.1 | 0.0125 | 0.04 | 0.003 |
| 3 | Al—9Si—0.45Mg—0.75Cu—4Zn | 9 | 0.75 | 0.45 | 4 | | <0.1 | 0.0125 | 0.04 | 0.003 |
| 4 | Al—9Si—0.45Mg—0.75Cu | 9 | 0.75 | 0.45 | 0 | | <0.1 | 0.0125 | 0.04 | 0.003 |
| 5 | Al—9Si—0.5Mg—0.75Cu | 9 | 0.75 | 0.5 | 0 | | <0.1 | 0.0125 | 0.04 | 0.003 |
| 6 | Al—9Si—0.35Mg—1.25Cu | 9 | 1.25 | 0.35 | 0 | | <0.1 | 0.0125 | 0.04 | 0.003 |
| 7 | Al—9Si—0.45Mg—1.25Cu | 9 | 1.25 | 0.45 | 0 | | <0.1 | 0.0125 | 0.04 | 0.003 |
| 8 | Al—9Si—0.55Mg—1.25Cu | 9 | 1.25 | 0.55 | 0 | | <0.1 | 0.0125 | 0.04 | 0.003 |
| 9 | Al—9Si—0.35Mg—1.75Cu | 9 | 1.75 | 0.35 | 0 | | <0.1 | 0.0125 | 0.04 | 0.003 |
| 10 | Al—9Si—0.35Mg—1.75Cu—0.5Ag | 9 | 1.75 | 0.35 | 0 | 0.5 | <0.1 | 0.0125 | 0.04 | 0.003 |

A modified ASTM tensile-bar mold was used for the casting. A lubricating mold spray was used on the gauge section, while an insulating mold spray was used on the remaining portion of the cavity. Thirty castings were made for each alloy. The average cycle time was about two minutes. The actual compositions investigated are listed in Table 4, below.

TABLE 4

Actual Compositions

| | Alloy | Actual Composition (wt %) | | | | | | | | |
|---|---|---|---|---|---|---|---|---|---|---|
| | | Si | Cu | Mg | Zn | Ag | Fe | Sr* | Ti | B |
| 1 | Al—9Si—0.5Mg | 8.87 | 0.021 | 0.48 | 0 | | 0.079 | 0.0125 | 0.05 | 0.003 |
| 2 | Al—9Si—0.35Mg—0.75Cu—4Zn | 9.01 | 0.75 | 0.37 | 4.03 | | 0.077 | 0.0125 | 0.031 | 0.003 |
| 3 | Al—9Si—0.45Mg—0.75Cu—4Zn | 9.09 | 0.75 | 0.46 | 4.02 | | 0.081 | 0.0125 | 0.04 | 0.003 |
| 4 | Al—9Si—0.45Mg—0.75Cu | 9.18 | 0.76 | 0.45 | | | 0.083 | 0.0125 | 0.042 | 0.003 |
| 5 | Al—9Si—0.5Mg—0.75Cu | 9.02 | 0.77 | 0.49 | | | 0.081 | 0.0125 | 0.013 | 0.003 |
| 6 | Al—9Si—0.35Mg—1.25Cu | 9.02 | 1.25 | 0.34 | | | 0.088 | 0.0125 | 0.03 | 0.003 |
| 7 | Al—9Si—0.45Mg—1.25Cu | 9.11 | 1.28 | 0.44 | | | 0.082 | 0.0125 | 0.04 | 0.003 |
| 8 | Al—9Si—0.55Mg—1.25Cu | 8.99 | 1.27 | 0.53 | | | 0.1 | 0.0125 | 0.04 | 0.003 |
| 9 | Al—9Si—0.35Mg—1.75Cu | 9.29 | 1.83 | 0.37 | | | 0.08 | 0.0125 | 0.048 | 0.003 |
| 10 | Al—9Si—0.35Mg—1.75Cu—0.5Ag | 8.88 | 1.78 | 0.35 | | 0.5 | 0.081 | 0.0125 | 0.044 | 0.003 |

The actual compositions are very close to the target compositions. The hydrogen content (single testing) of the castings is given in Table 5.

TABLE 5

Hydrogen Content of the Castings

| | Alloy | H Content (ppm) |
|---|---|---|
| 1 | Al—9Si—0.5Mg | 0.14 |
| 2 | Al—9Si—0.35Mg—0.75Cu—4Zn | 0.11 |
| 3 | Al—9Si—0.45Mg—0.75Cu—4Zn | 0.19 |
| 4 | Al—9Si—0.45Mg—0.75Cu | 0.11 |
| 5 | Al—9Si—0.5Mg—0.75Cu | 0.14 |
| 6 | Al—9Si—0.35Mg—1.25Cu | 0.15 |
| 7 | Al—9Si—0.45Mg—1.25Cu | 0.13 |
| 8 | Al—9Si—0.55Mg—1.25Cu | 0.16 |
| 9 | Al—9Si—0.35Mg—1.75Cu | 0.13 |
| 10 | Al—9Si—0.35Mg—1.75Cu—0.5Ag | Not measured |

Note:
alloy 3 was degassed with porous lance; all other alloys were degassed using a rotary degasser.

1.3 The Preferred Solution Heat Treat Temperature as a Function of Cu and Mg

To dissolve all the Q-AlCuMgSi phase particles, the solution heat treatment temperature should be higher than the Q-AlCuMgSi phase formation temperature. Table 6 lists the calculated final eutectic temperature, Q-phase formation temperature and solidus temperature using the targeted composition of the ten alloys investigated.

TABLE 6

Calculated Final Eutectic Temperature, Q-phase Formation Temperature and Solidus Temperature for Ten Investigated Casting Alloys

| | Alloy | Final eutectic temperature, C. | Q-phase forming temperature, C. | Solidus temperature, C. |
|---|---|---|---|---|
| 1 | Al—9Si—0.5Mg | 560 | — | 563 |
| 2 | Al—9Si—0.35Mg—0.75Cu—4Zn | 470 | 518 | 540 |
| 3 | Al—9Si—0.45Mg—0.75Cu—4Zn | 470 | 518 | 543 |
| 4 | Al—9Si—0.45Mg—0.75Cu | 510 | 541 | 554 |
| 5 | Al—9Si—0.5Mg—0.75Cu | 510 | 541 | 553 |
| 6 | Al—9Si—0.35Mg—1.25Cu | 510 | 533 | 552 |
| 7 | Al—9Si—0.45Mg—1.25Cu | 510 | 536 | 548 |
| 8 | Al—9Si—0.55Mg—1.25Cu | 510 | 538 | 545 |
| 9 | Al—9Si—0.35Mg—1.75Cu | 510 | 528 | 543 |
| 10 | Al—9Si—0.35Mg—1.75Cu—0.5Ag | 510 | 526 | 543 |

Based on the above mentioned information, two solution heat treatment practices were defined and used. Alloys 2, 3, 9 and 10 had lower solidus temperature and/or lower final eutectic/Q-phase formation temperature than others. Hence a different SHT practice was used.

The practice I for alloys 2, 3, 9 and 10 was:

1.5 hour log heat-up to 471° C.

2 hour soak at 471° C.

0.5 hour ramp up to 504° C.

4 hour soak at 504° C.

0.5 hour ramp up to $T_H$ 6 hour soak at $T_H$

CWQ (Cold Water Quench)

and practice II for other six alloys was:

1.5 hour log heat-up to 491° C.

2 hour soak at 491° C.

0.25 hour ramp up to 504° C.

4 hour soak at 504° C.

0.5 hour ramp up to $T_H$ 6 hour soak at $T_H$

CWQ (Cold Water Quench)

The final step solution heat treatment temperature $T_H$ was determined from following equation based on Mg and Cu content:

$$T_H(^\circ\text{ C.})=570-10.48*Cu-71.6*Mg-1.3319*Cu*Mg-0.72*Cu*Cu+72.95*Mg*Mg, \quad (2)$$

Where, Mg and Cu are magnesium and copper contents, in wt %

A lower limit for $T_H$ is defined by:

$$T_Q=533.6-20.98*Cu+88.037*Mg+33.43*Cu*Mg-0.7763*Cu*Cu-126.267*Mg*Mg \quad (3)$$

An upper limit for $T_H$ is defined by:

$$T_S=579.2-10.48*Cu-71.6*Mg-1.3319*Cu*Mg-0.72*Cu*Cu+72.95*Mg*Mg \quad (4)$$

Figure 8:
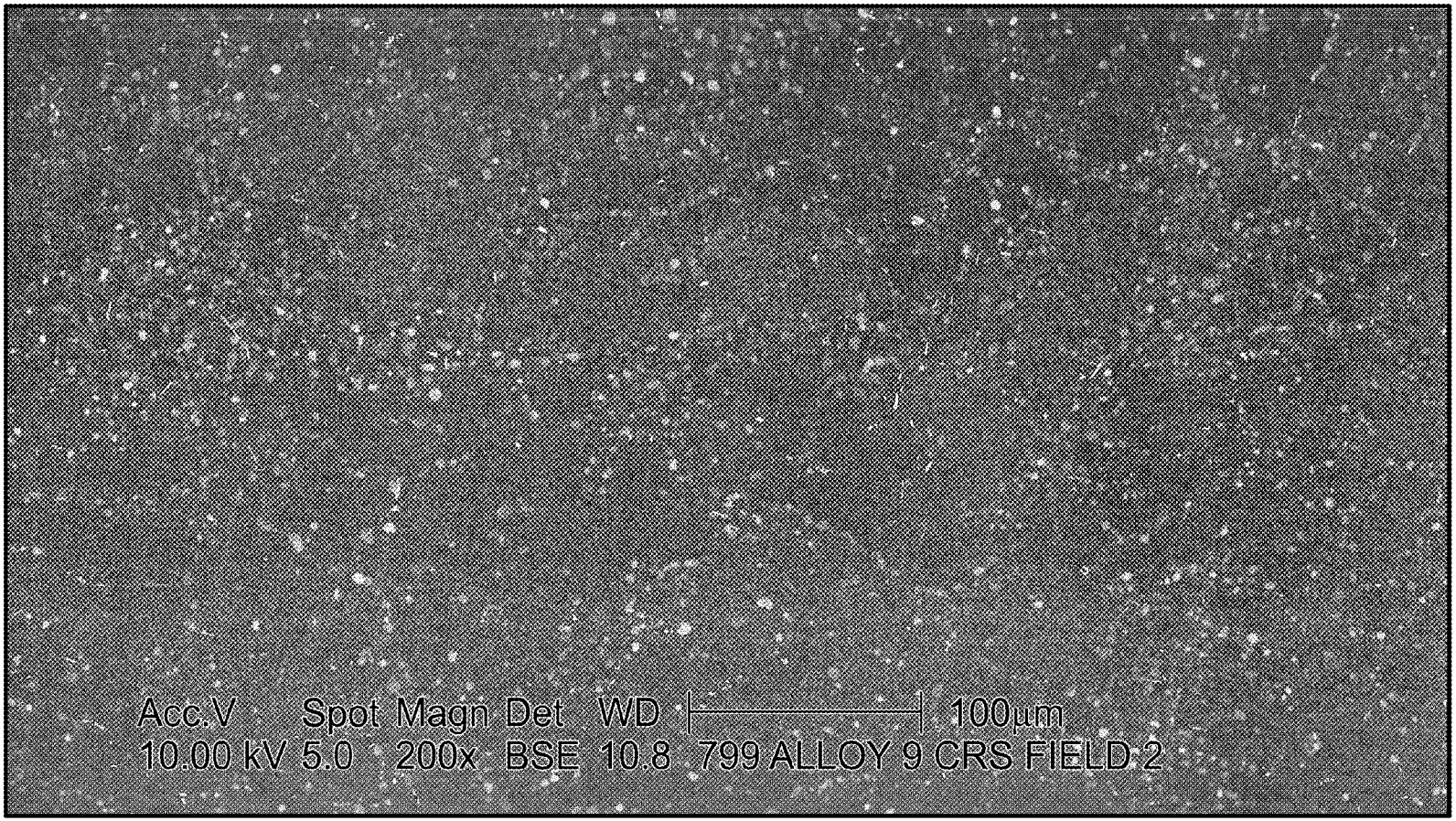
FIG. 8 is an SEM (scanning electron micrograph) @200× magnification, showing spherical Si particles and un-dissolved Fe-containing particles.
Figure 9:
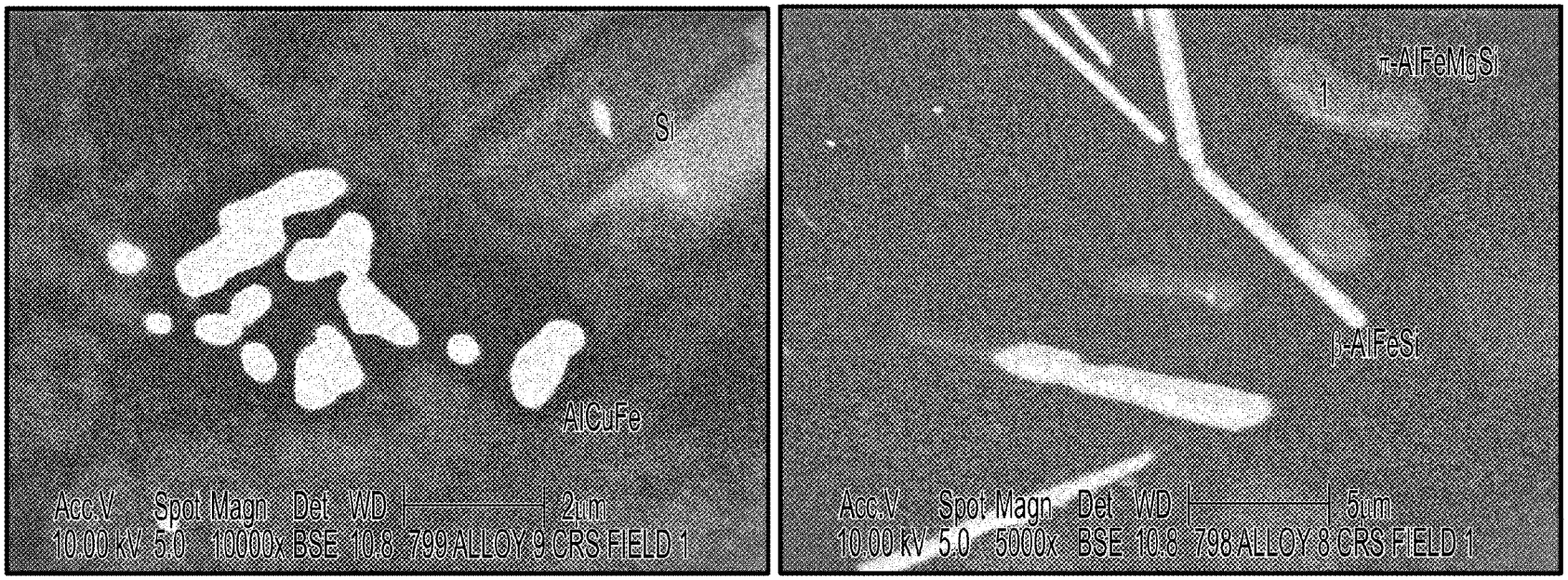
FIGS. 9*a-b* are photographs of undissolved Fe-containing particles in the investigated alloys.

The microstructure of the solution heat treated specimens was characterized using optical and SEM microscopy. There were no un-dissolved Q-phase particles detected in all the Cu-containing alloys investigated. FIG. 8 shows the microstructure of the Al-9% Si-0.35% Mg-1.75% Cu alloy (alloy #9) in the T6 temper. Si particles were all well-spheroidized. Some un-dissolved particles were identified as β-AlFeSi, π-AlFeMgSi and $Al_7Cu_2Fe$ phases. The morphologies of these un-dissolved phases are shown in FIG. 9 at higher magnification.

1.4 Experimental Results 1.4.1 Property Characterization

Tensile properties were evaluated according to the ASTM B557 method. Test bars were cut from the modified ASTM B108 castings and tested on the tensile machine without any further machining. All the tensile results are an average of five specimens. Toughness of selected alloys was evaluated using the un-notched Charpy Impact test, ASTM E23-07a. The specimen size was 10 mm×10 mm×55 mm machined from the tensile-bar casting. Two specimens were measured for each alloy.

Smooth S—N fatigue test was conducted according to the ASTM E606 method. Three stress levels, 100 MPa, 150 MPa, and 200 MPa were evaluated. The R ratio was −1 and the frequency was 30 Hz. Three replicated specimens were tested for each condition. Test was terminated after about $10^7$ cycles. Smooth fatigue round specimens were obtained by slightly machining the gauge portion of the tensile bar casting.

Corrosion resistance (type-of-attack) of selected conditions was evaluated according to the ASTM G110 method. Corrosion mode and depth-of-attack on both the as-cast surface and machined surface were assessed.

All the raw test data including tensile, Charpy impact and S—N fatigue are given in Tables 7 to 9. A summary of the findings is given in the following sections.

TABLE 7

Mechanical properties of various alloys aged at 155° C. for different times*

| Alloy | Aged at 155° C. for 15 hrs | | | | Aged at 155° C. for 30 hrs | | | | Aged at 155° C. for 60 hrs | | | |
|---|---|---|---|---|---|---|---|---|---|---|---|---|
| | UTS (MPa) | TYS (MPa) | E (%) | Q (MPa) | UTS (MPa) | TYS (MPa) | E (%) | Q (MPa) | UTS (MPa) | TYS (MPa) | E (%) | Q (MPa) |
| 1. Al—9Si—0.5Mg | 405.8 | 323.3 | 8.3 | 543.2 | 398.5 | 326.5 | 6.5 | 520.4 | 398.7 | 340.2 | 5.3 | 507.7 |
| 2. Al—9Si—0.35Mg—0.75Cu—4Zn | 431.5 | 342.0 | 5.5 | 542.6 | 433.5 | 358.0 | 4.5 | 531.5 | 446.8 | 366.0 | 6.5 | 568.7 |
| 3. Al—9Si—0.45Mg—0.75Cu—4Zn | 460.5 | 370.5 | 5.5 | 571.6 | 469.0 | 378.5 | 7.0 | 595.8 | 465.3 | 390.7 | 5.0 | 570.2 |
| 4. Al—9Si—0.45Mg—0.75Cu | 451.5 | 339.0 | 6.5 | 573.4 | 450.5 | 354.8 | 5.0 | 555.3 | 464.0 | 373.5 | 6.5 | 585.9 |
| 5. Al—9Si—0.5Mg—0.75Cu | 426.0 | 317.3 | 8.0 | 561.5 | 442.8 | 348.2 | 6.7 | 566.4 | 442.5 | 364.5 | 6.0 | 559.2 |
| 6. Al—9Si—0.35Mg—1.25Cu | 411.2 | 299.2 | 7.3 | 540.2 | 436.3 | 326.3 | 7.0 | 563.1 | 446.5 | 342.8 | 6.5 | 568.4 |
| 7. Al—9Si—0.45Mg—1.25Cu | 424.3 | 328.0 | 4.8 | 525.8 | 453.8 | 353.0 | 5.8 | 567.7 | 455.3 | 375.8 | 4.0 | 545.6 |
| 8. Al—9Si—0.55Mg—1.25Cu | 444.8 | 336.5 | 6.0 | 561.6 | 460.3 | 365.3 | 4.8 | 561.8 | 475.8 | 385.0 | 4.8 | 577.3 |
| 9. Al—9Si—0.35Mg—1.75Cu | 465.7 | 325.0 | 9.0 | 608.8 | 459.5 | 355.3 | 5.5 | 570.6 | 478.8 | 386.3 | 5.0 | 583.6 |
| 10. Al—9Si—0.35Mg—1.75Cu—0.5Ag | 463.3 | 343.0 | 7.5 | 594.5 | 471.7 | 364.5 | 6.3 | 591.9 | 471.0 | 389.3 | 4.5 | 569.0 |

*Averaged value from five tensile specimens.
The Quality Index, Q = UTS + 150 log(E).

TABLE 8

Charpy impact test results for some selected alloys

| Alloy | Energy (ft-lbs) | | | |
|---|---|---|---|---|
| | 155° C./15 hrs | | 155° C./60 hrs | |
| | specimen 1 | Specimen 3 | Specimen 7 | Specimen 9 |
| 1. Al—9Si—0.5Mg | 6 | 27 | 23 | 27 |
| 3. Al—9Si—0.45Mg—0.75Cu—4Zn | 17 | 18 | 10 | 12 |
| 4. Al—9Si—0.45Mg—0.75Cu | 32 | 15 | 28 | 13 |
| 7. Al—9Si—0.45Mg—1.25Cu | 27 | 12 | 7 | 12 |
| 9. Al—9Si—0.35Mg—1.75Cu | 16 | 15 | 8 | 9 |

TABLE 9

S—N fatigue results for some selected alloys aged at 155 C. for 60 hours (Smooth, Axial; stress ratio = −1)

| Alloy | Stress (MPa) | Cycles to Failure | |
|---|---|---|---|
| | | 155 C./15 hrs | 155 C./60 hrs |
| 1. Al—9Si—0.5Mg | 100 | 1680725 | 1231620 |
| 1. Al—9Si—0.5Mg | 100 | 1302419 | 272832 |
| 1. Al—9Si—0.5Mg | 100 | 4321029 | 1077933 |
| 1. Al—9Si—0.5Mg | 150 | 71926 | 148254 |
| 1. Al—9Si—0.5Mg | 150 | 242833 | 42791 |
| 1. Al—9Si—0.5Mg | 150 | 153073 | 56603 |
| 1. Al—9Si—0.5Mg | 200 | 16003 | 54623 |
| 1. Al—9Si—0.5Mg | 200 | 8654 | 30708 |
| 1. Al—9Si—0.5Mg | 200 | 36597 | 39376 |
| 3. Al—9Si—0.45Mg—0.75Cu—4Zn | 100 | 160572 | 248032 |
| 3. Al—9Si—0.45Mg—0.75Cu—47n | 100 | 298962 | 131397 |
| 3. Al—9Si—0.45Mg—0.75Cu—4Zn | 100 | 120309 | 394167 |
| 3. Al—9Si—0.45Mg—0.75Cu—4Zn | 150 | 120212 | 12183 |
| 3. Al—9Si—0.45Mg—0.75Cu—47n | 150 | 70152 | 42074 |
| 3. Al—9Si—0.45Mg—0.75Cu—4Zn | 150 | 190200 | 31334 |
| 3. Al—9Si—0.45Mg—0.75Cu—4Zn | 200 | 38369 | 18744 |
| 3. Al—9Si—0.45Mg—0.75Cu—4Zn | 200 | 29686 | 14822 |
| 3. Al—9Si—0.45Mg—0.75Cu—4Zn | 200 | 39366 | 11676 |

TABLE 9-continued

S—N fatigue results for some selected alloys aged at 155 C. for 60 hours (Smooth, Axial; stress ratio = −1)

| Alloy | Stress (MPa) | Cycles to Failure | |
|---|---|---|---|
| | | 155 C./15 hrs | 155 C./60 hrs |
| 4. Al—9Si—0.45Mg—0.75Cu | 100 | 485035 | 575446 |
| 4. Al—9Si—0.45Mg—0.75Cu | 100 | 4521553 | 233110 |
| 4. Al—9Si—0.45Mg—0.75Cu | 100 | 3287495 | 940229 |
| 4. Al—9Si—0.45Mg—0.75Cu | 150 | 170004 | 141654 |
| 4. Al—9Si—0.45Mg—0.75Cu | 150 | 110500 | 234640 |
| 4. Al—9Si—0.45Mg—0.75Cu | 150 | 688783 | 238478 |
| 4. Al—9Si—0.45Mg—0.75Cu | 200 | 108488 | 22686 |
| 4. Al—9Si—0.45Mg—0.75Cu | 200 | 40007 | 36390 |
| 4. Al—9Si—0.45Mg—0.75Cu | 200 | 51678 | 20726 |
| 7. Al—9Si—0.45Mg—1.25Cu | 100 | 1115772 | 1650686 |
| 7. Al—9Si—0.45Mg—1.25Cu | 100 | 318949 | 1744140 |
| 7. Al—9Si—0.45Mg—1.25Cu | 100 | 468848 | 484262 |
| 7. Al—9Si—0.45Mg—1.25Cu | 150 | 102341 | 232171 |
| 7. Al—9Si—0.45Mg—1.25Cu | 150 | 145766 | 106741 |
| 7. Al—9Si—0.45Mg—1.25Cu | 150 | 63720 | 226188 |
| 7. Al—9Si—0.45Mg—1.25Cu | 200 | 41686 | 21873 |
| 7. Al—9Si—0.45Mg—1.25Cu | 200 | 20709 | 58819 |
| 7. Al—9Si—0.45Mg—1.25Cu | 200 | 52709 | 4367 |
| 9. Al—9Si—0.35Mg—1.75Cu | 100 | 2159782 | 2288145 |
| 9. Al—9Si—0.35Mg—1.75Cu | 100 | 354677 | 1011473 |
| 9. Al—9Si—0.35Mg—1.75Cu | 100 | 4258369 | 783758 |
| 9. Al—9Si—0.35Mg—1.75Cu | 150 | 281867 | 164554 |
| 9. Al—9Si—0.35Mg—1.75Cu | 150 | 135810 | 188389 |
| 9. Al—9Si—0.35Mg—1.75Cu | 150 | 100053 | 146740 |
| 9. Al—9Si—0.35Mg—1.75Cu | 200 | 24014 | 48506 |
| 9. Al—9Si—0.35Mg—1.75Cu | 200 | 30695 | 8161 |
| 9. Al—9Si—0.35Mg—1.75Cu | 200 | 62211 | 31032 |

1.4.2 Mechanical Properties at Room Temperature

1.4.2.1 Effect of Aging Temperature on Tensile Properties

The effect of artificial aging temperature on tensile properties was investigated using the baseline alloy 1-Al-9% Si-0.5% Mg. After a minimum 4 hours of natural aging, the tensile bar castings were aged at 155° C. for 15, 30, 60 hours and at 170° C. for 8, 16, 24 hours. Three replicate specimens were used for each aging condition.

Figure 10:
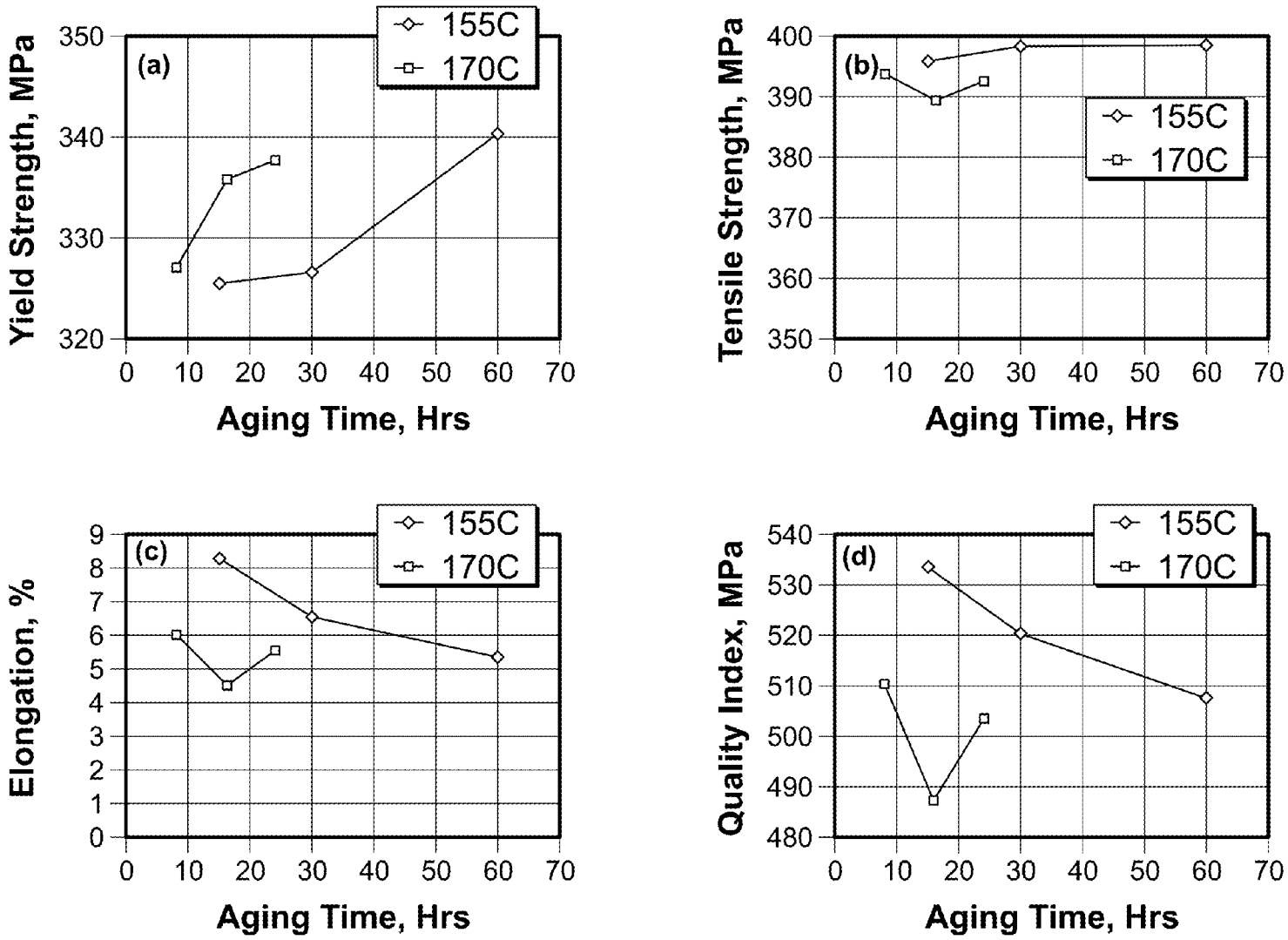
FIGS. 10*a-d* are graphs of the effect of aging condition on tensile properties of the Al-9Si-0.5Mg alloy.

FIG. 10 shows the tensile properties of the baseline A359 alloy (Al-9% Si-0.5% Mg) at various aging conditions. Low aging temperature (155° C.) tends to yield higher quality index than the high aging temperature (170° C.). Thus, the low aging temperature at 155° C. was selected, even though the aging time is longer to obtain improved properties.

2.4.2.2 Effects of Alloy Elements on Tensile Properties

Figure 11:
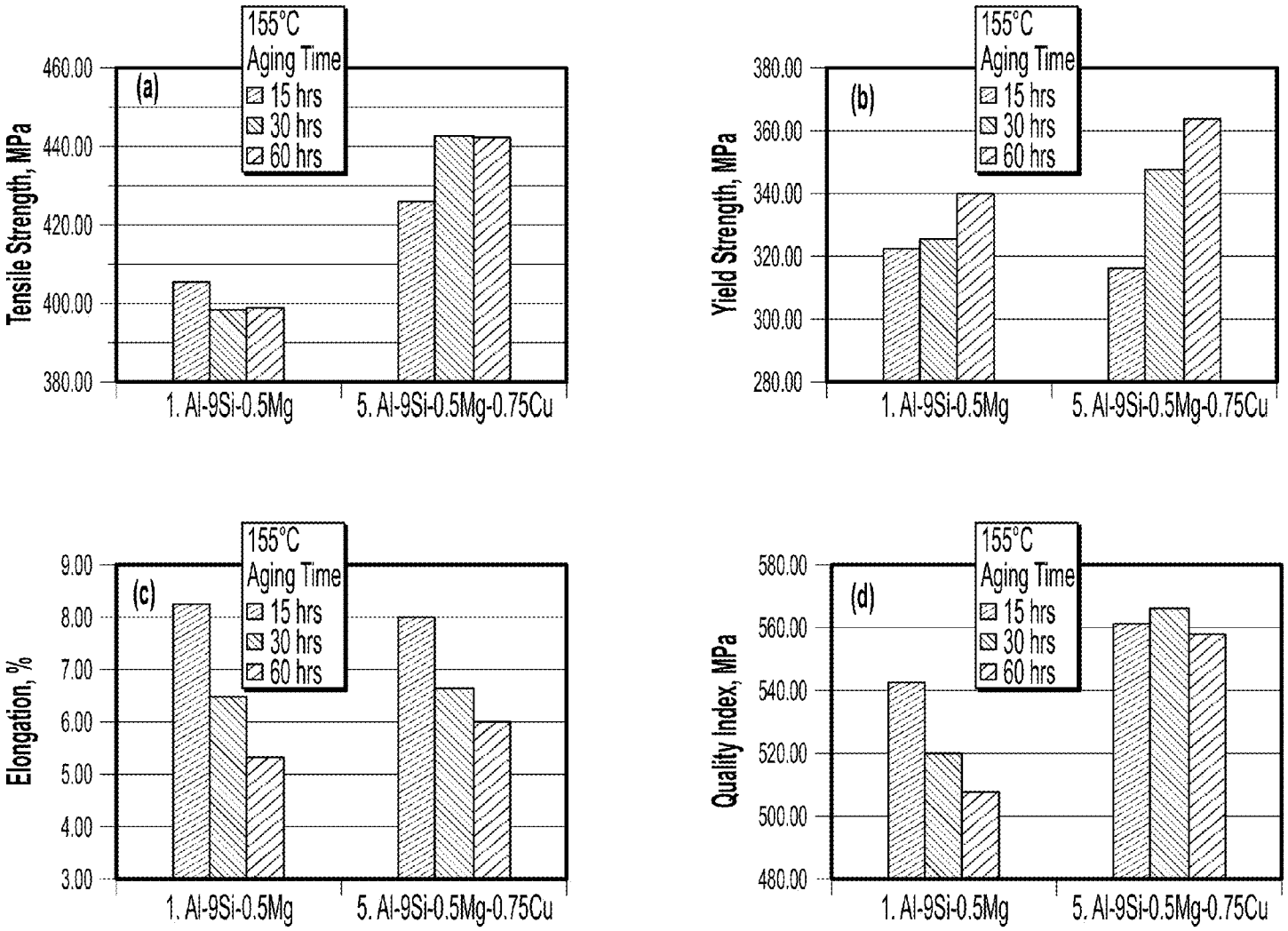
FIGS. 11*a-d* are graphs of the effect of Cu on tensile properties of the Al-9% Si-0.5% Mg alloy.

FIG. 11 compares the tensile properties of baseline Al-9% Si-0.5% Mg alloy and Al-9% Si-0.5% Mg-0.75% Cu alloy. The addition of 0.75% Cu to Al-9% Si-0.5% Mg alloy increases the yield strength by ~20 MPa and ultimate tensile strength by ~40 MPa while maintaining the elongation. The average quality index of the Cu-containing alloy is ~560 MPa, which is much higher than the baseline alloy with an average of ~520 MPa.

Figure 12:
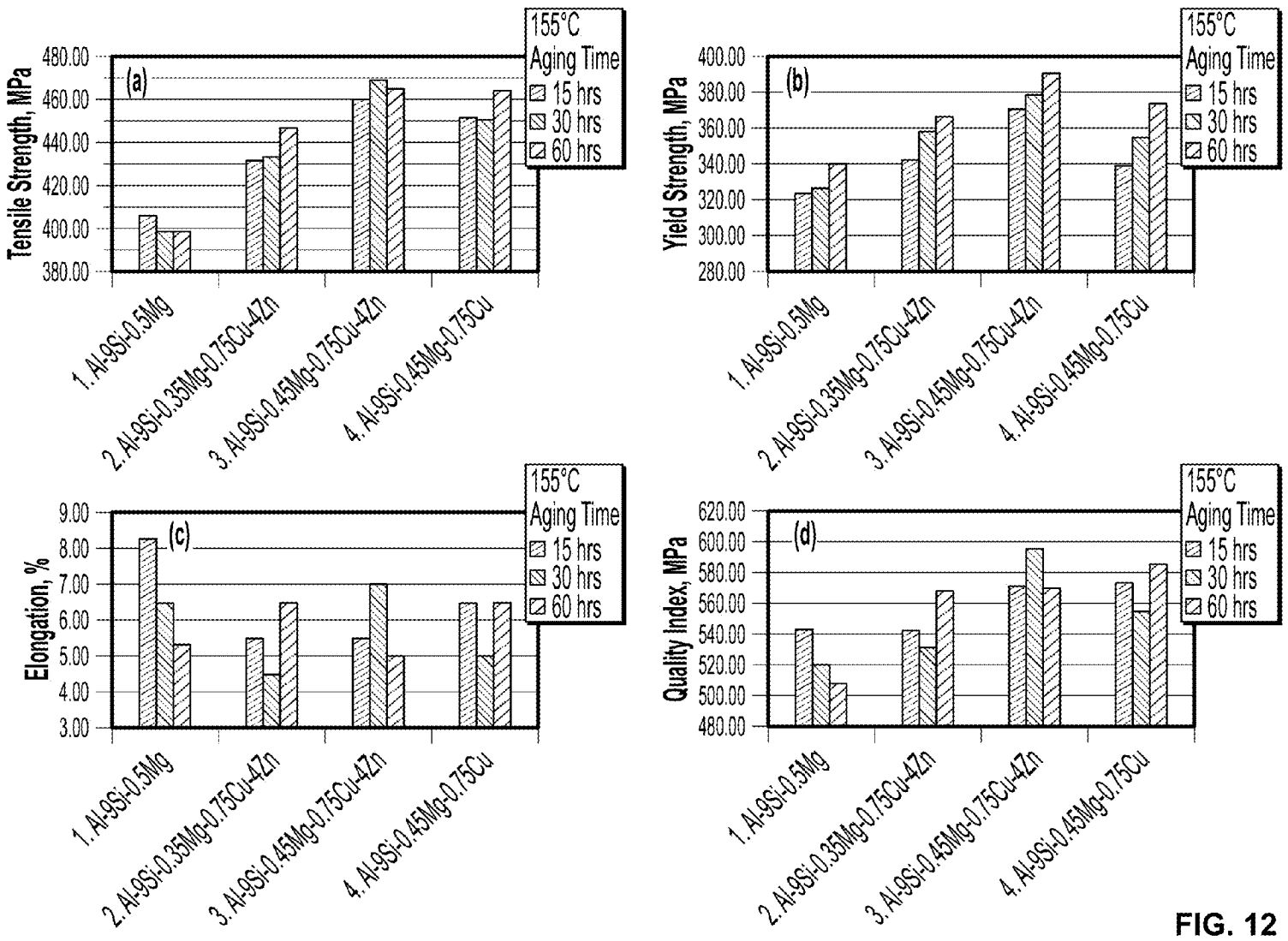
FIGS. 12*a-d* are graphs of the effect of Cu and Zn on tensile properties of the Al-9% Si-0.5% Mg alloy.

FIG. 12 compares the tensile properties of four cast alloys, 1, 2, 3 and 4. Alloy 1 is the baseline alloy. Alloy 2-4 all contain 0.75% Cu with various amounts of Mg and/or Zn. Alloys 3 and 4 contain 0.45% Mg, while alloy 2 contains 0.35% Mg and alloy 1 contains 0.5% Mg. Alloys 2 and 3 also have 4% Zn. A preliminary assessment of these four alloys indicates that Mg and Zn increase alloy strength without sacrificing ductility. A direct comparison between alloys 3 and 4 indicates that by adding 4% Zn to the Al-9% Si-0.45% Mg-0.75% Cu alloy, both ultimate tensile strength and yield strength are increased while maintaining the elongation. The 4% Zn addition also increases the aging kinetics as indicated in FIG. 12. When aged at 155° C. for 15 hours, yield strength of about 370 MPa can be achieved for the Al-9% Si-0.45% Mg-0.75% Cu-4% Zn alloy, which is about 30 MPa higher than that of the alloy without Zn.

Figure 13:
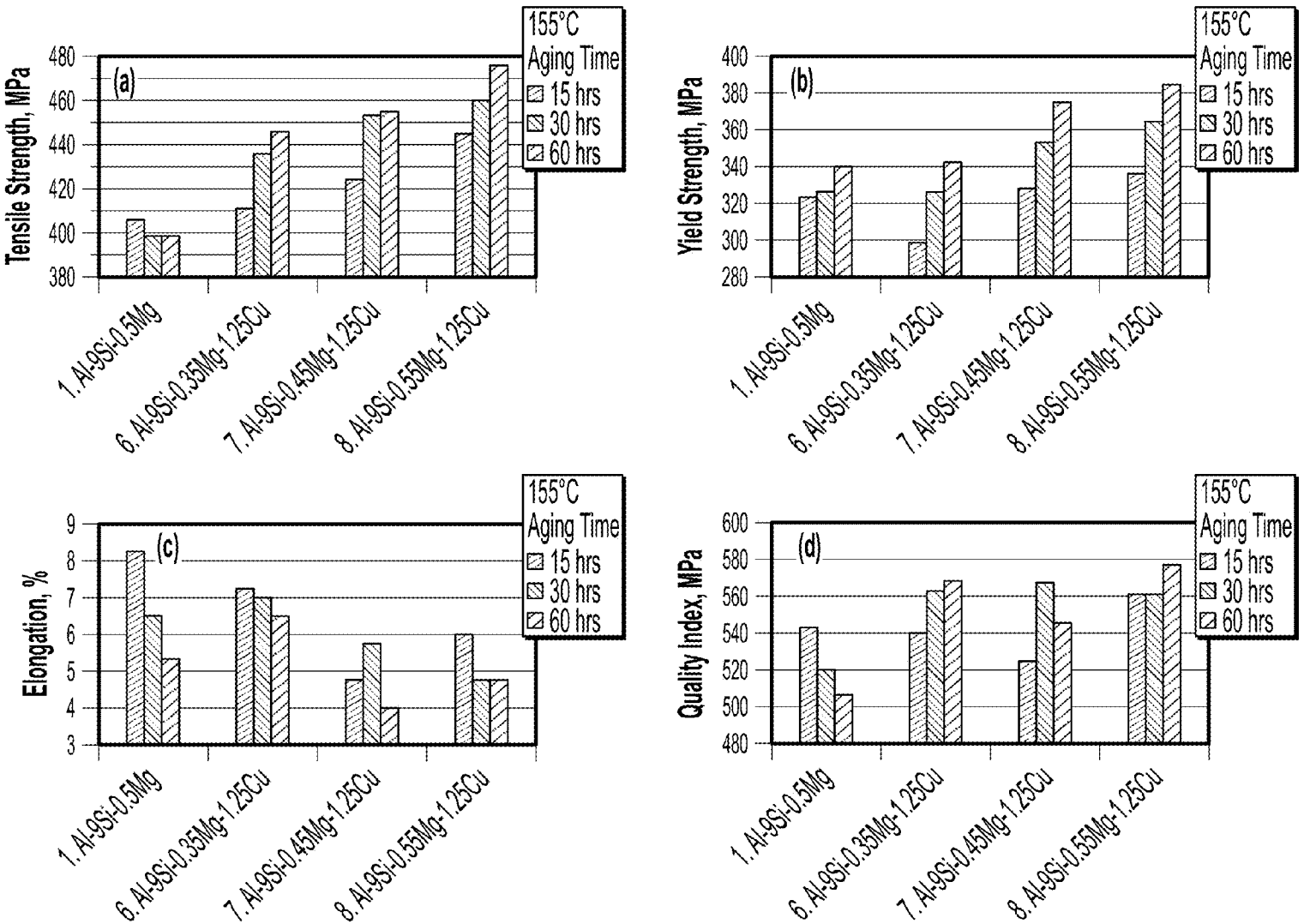
FIGS. 13*a-d* are graphs of the effect of Mg content on tensile properties of the Al-9% Si-1.25% Cu—Mg alloy.

FIG. 13 shows the effect of Mg content (0.35-0.55 wt %) on the tensile properties of the Al-9% Si-1.25% Cu—Mg alloys (Alloys 6-8). The tensile properties of the baseline alloy Al-9% Si-0.5% Mg are also included for comparison. Mg content showed significant influence on the tensile properties. With increasing Mg content, both yield strength and tensile strength were increased, but the elongation was decreased. The decrease of elongation with increasing Mg content could be related to higher amount of π-AlFeMgSi phase particles even if all the Q-AlCuMgSi phase particles were dissolved. The impact of Mg content on quality indexes of the Al-9% Si-1.25% Cu—Mg alloys was overall found to be insignificant.

Figure 14:
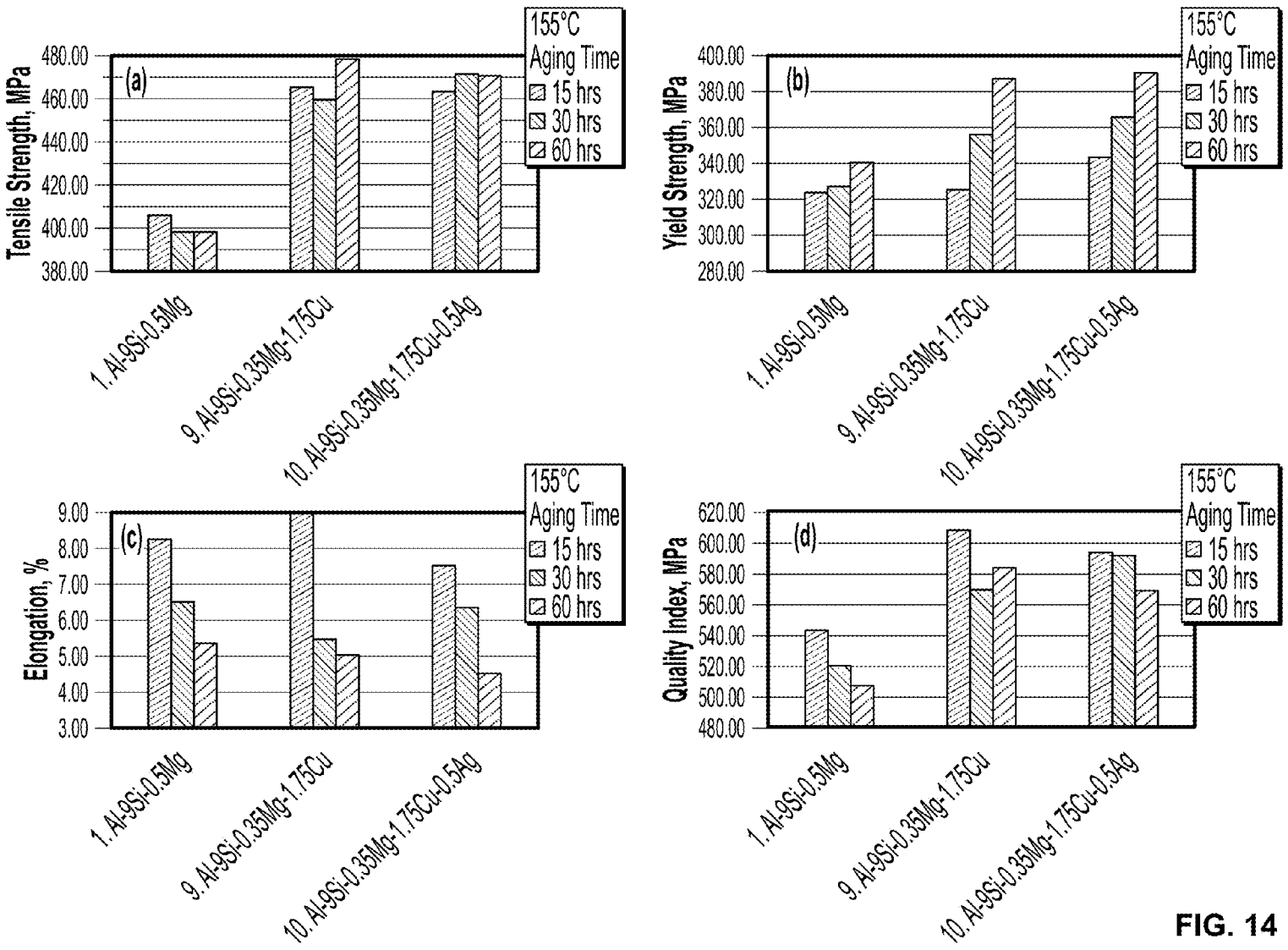
FIGS. 14*a-d* are graphs of the effect of Ag on tensile properties of the Al-9% Si-0.35% Mg-1.75% Cu alloy.
Figure 15:
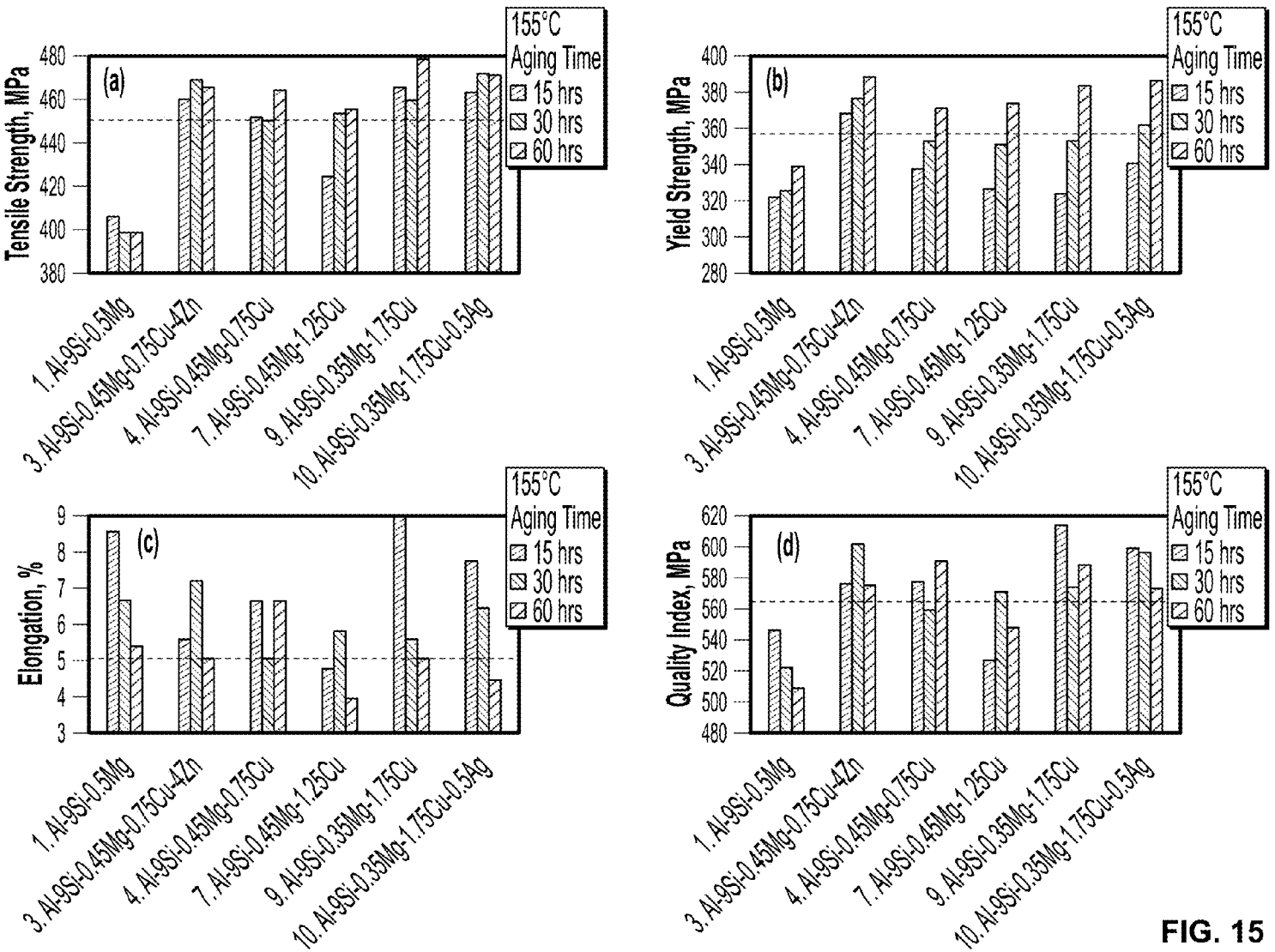
FIGS. 15*a-d* are graphs of tensile properties for six alloys aged for different times at an elevated temperature, as described in the disclosure.

FIG. 14 shows the effect of Ag (0.5 wt %) on the tensile properties of Al-9% Si-0.35% Mg-1.75% Cu alloy. An addition of 0.5 wt % Ag had very limited impact on strength, elongation and quality index of the Al-9% Si-0.35% Mg-1.75% Cu alloy. It should be noted that the quality index of the Al-9% Si-0.35% Mg-1.75% Cu (without Ag) alloy is ~60 MPa higher than the baseline alloy, A359 (Alloy 1)

FIGS. 15*a*-15*d* show the tensile properties of five promising alloys in accordance with the present disclosure along with the baseline alloy Al-9Si-0.5Mg (alloy 1). These five alloys achieve the target tensile properties, i.e., 10-15% increase in tensile and maintaining similar elongation as A356/A357 alloy. The alloys are: Al-9% Si-0.45% Mg-0.75% Cu (Alloy 4), Al-9% Si-0.45% Mg-0.75% Cu-4% Zn(Alloy 3), Al-9% Si-0.45% Mg-1.25% Cu (Alloy 7), Al-9% Si-0.35% Mg-1.75% Cu (Alloy 9), and Al-9% Si-0.35% Mg-1.75% Cu-0.5% Ag (Alloy 10).

Based on the data, it is believed that the following tensile properties can be obtained with alloys aged at 155° C. for time ranged from 15 to 60 hrs.

Ultimate tensile strength: 450-470 MPa

Tensile yield strength: 360-390 MPa

Elongation: 5-7%

Quality index: 560-590 MPa

These properties are much higher than A359 (Alloy 1) and are very similar to A201 (Al4.6Cu0.35Mg0.7Ag) cast alloy (UTS 450 MPa, TYS 380 MPa, Elongation 8%, and Q 585 MPa) ASM Handbook Volume 15, Casting, ASM International, December 2008. On the other hand, the castability of these Al-9% Si—Mg—Cu alloys is much better than A201 alloy. The A201 alloy has a poor castability due to its high tendency of hot cracking and Cu macro-segregation. Additionally, the material cost of A201 with 0.7 wt % Ag is also much higher than those embodiments in accordance with the present disclosure that are Ag-free.

Based on the tensile property results, four alloys without Ag (Alloys 3, 4, 7 and 9) with promising tensile properties along with baseline alloy, A359 (Alloy 1) were selected for further investigation. Charpy impact, S—N fatigue and general corrosion tests were conducted on these five alloys aged at 155° C. for 15 hours and 60 hours.

1.4.4 Charpy Impact Tests

Figure 16:
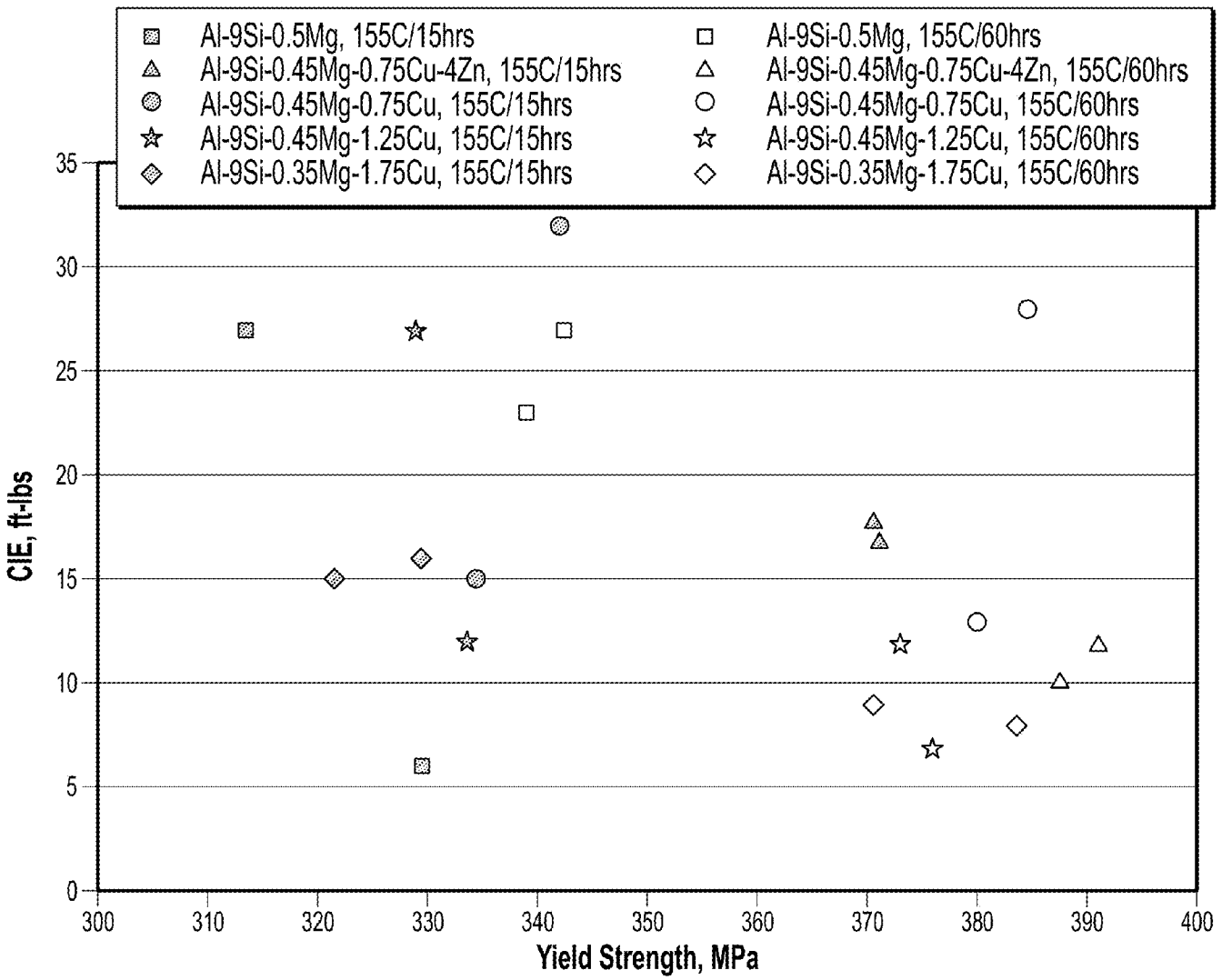
FIG. 16 is a graph of Charpy impact energy (CIE) vs. yield strength for five alloys aged for different times at an elevated temperature.

FIG. 16 shows the results of the individual tests by plotting Charpy impact energy vs. tensile yield strength. The filled symbols are for specimens aged at 155° C. for 15 hours and open symbols are for specimens aged at 155° C. for 60 hours. Tensile yield strength increases as the aging time increases, while the Charpy impact energy decreases with increasing aging time. The results indicate that most alloys/aging conditions follow the expected strength/toughness relationship. However, the results indeed show a slight degradation of the strength/toughness relationship with higher Cu content such as 1.25 and 1.75 wt %.

1.4.5 S—N Fatigue Tests

Aluminum castings are often used in engineered components subject to cycles of applied stress. Over their commercial lifetime millions of stress cycles can occur, so it is important to characterize their fatigue life. This is especially true for safety critical applications, such as automotive suspension components.

Figure 17:
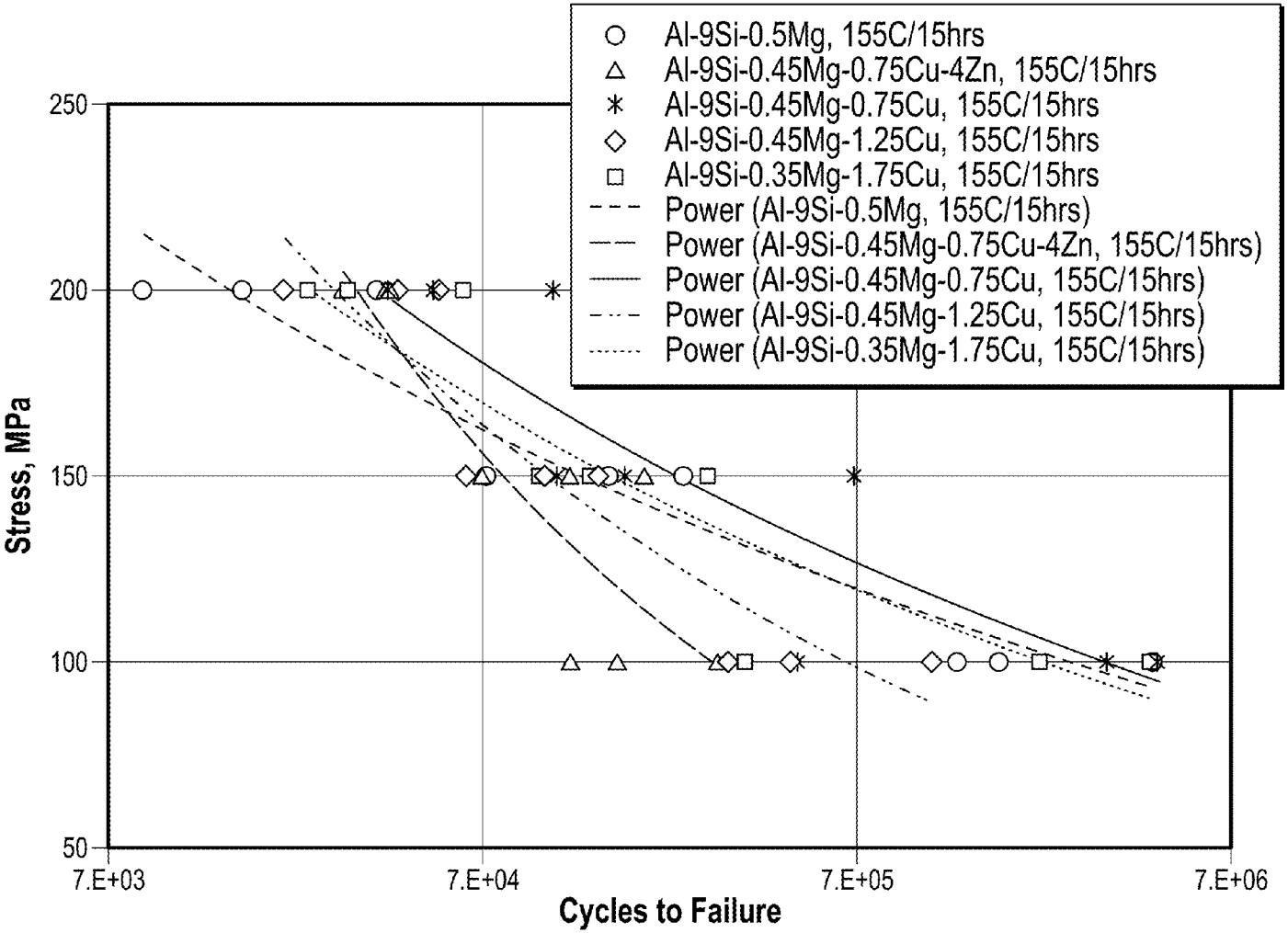
FIG. 17 is a graph of S—N fatigue curves of selected alloys aged at 155° C. for 15 hours. Smooth, Axial; stress ratio=−1.
Figure 18:
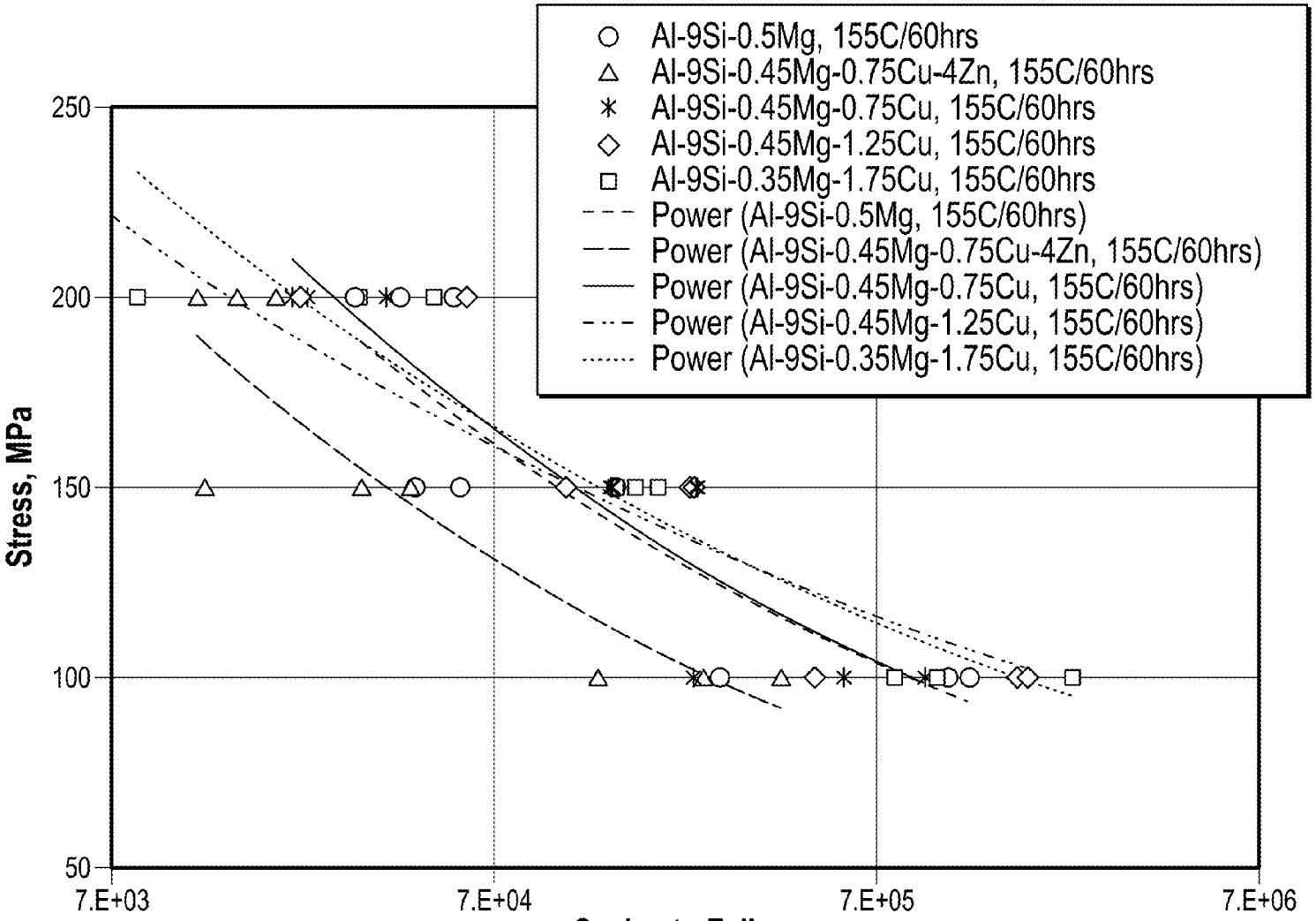
FIG. 18 is a graph of S—N fatigue curves of selected alloys aged at 155° C. for 60 hours. Smooth, Axial; stress ratio=−1.
Figure 19:
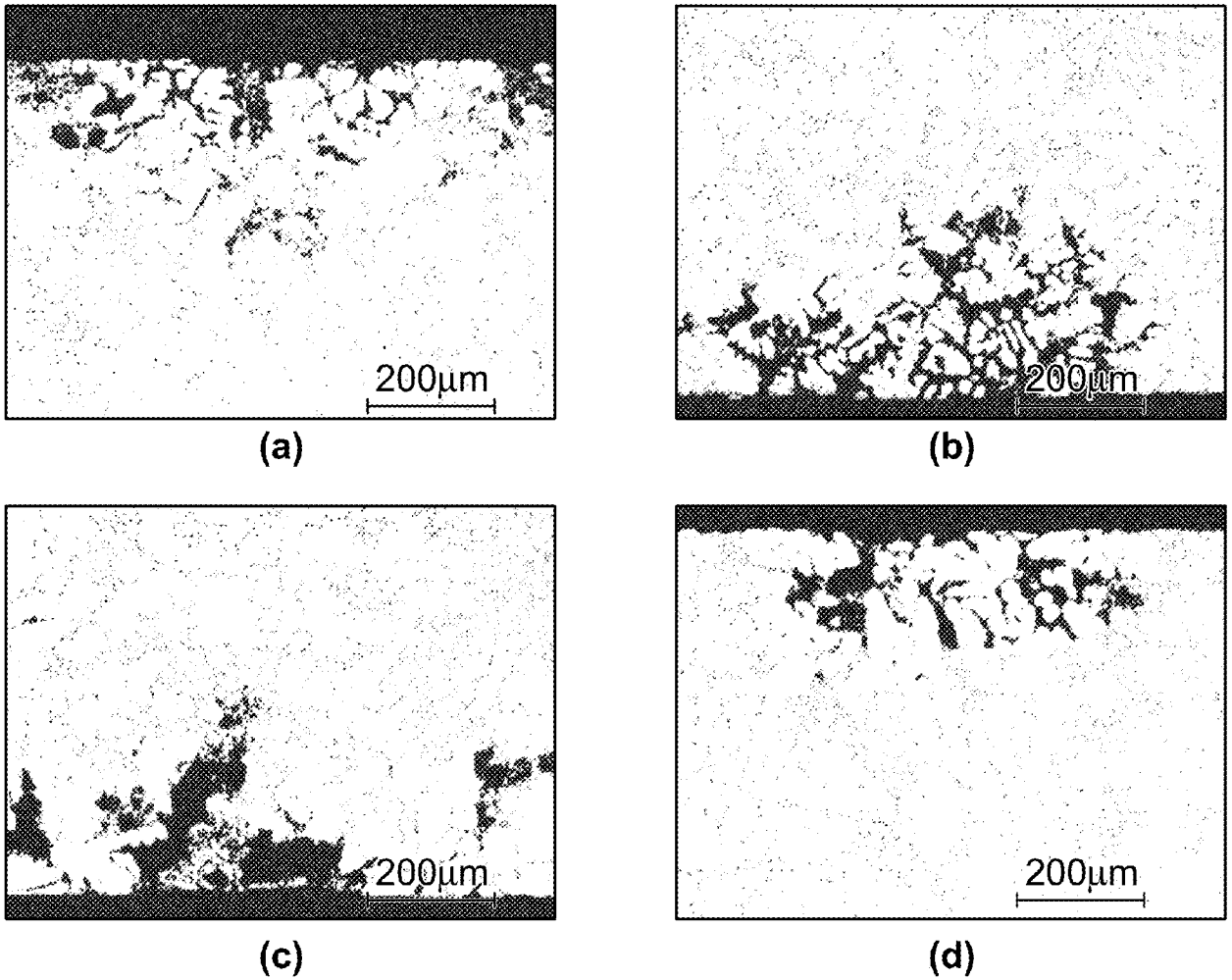
FIG. 19*a-d*-23*a-d* are optical micrographs of cross-sections of samples of five alloys as cast and machined and aged for two different time periods at an elevated temperature after 6-hour ASTM G110.
Figure 20:
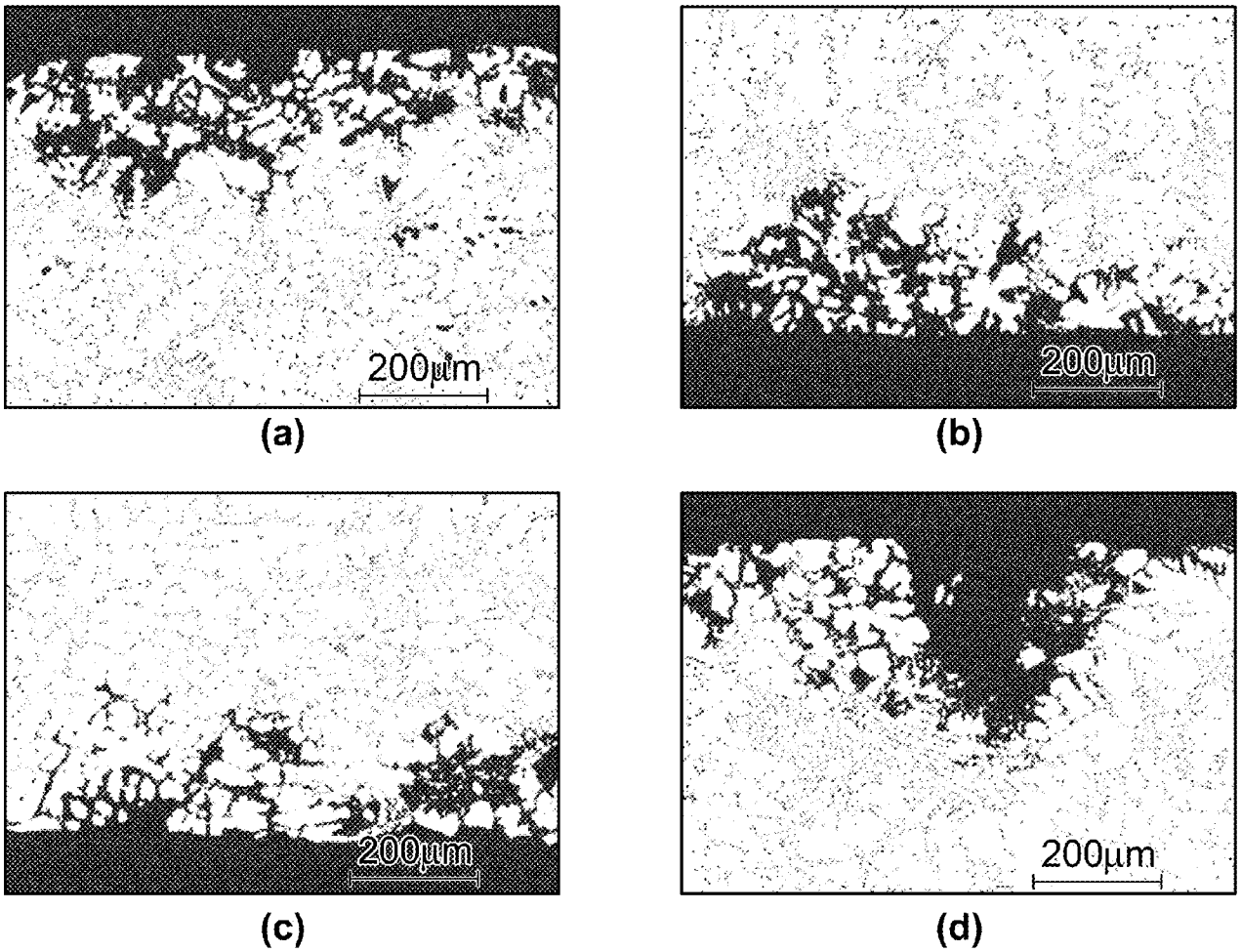
Figure 21:
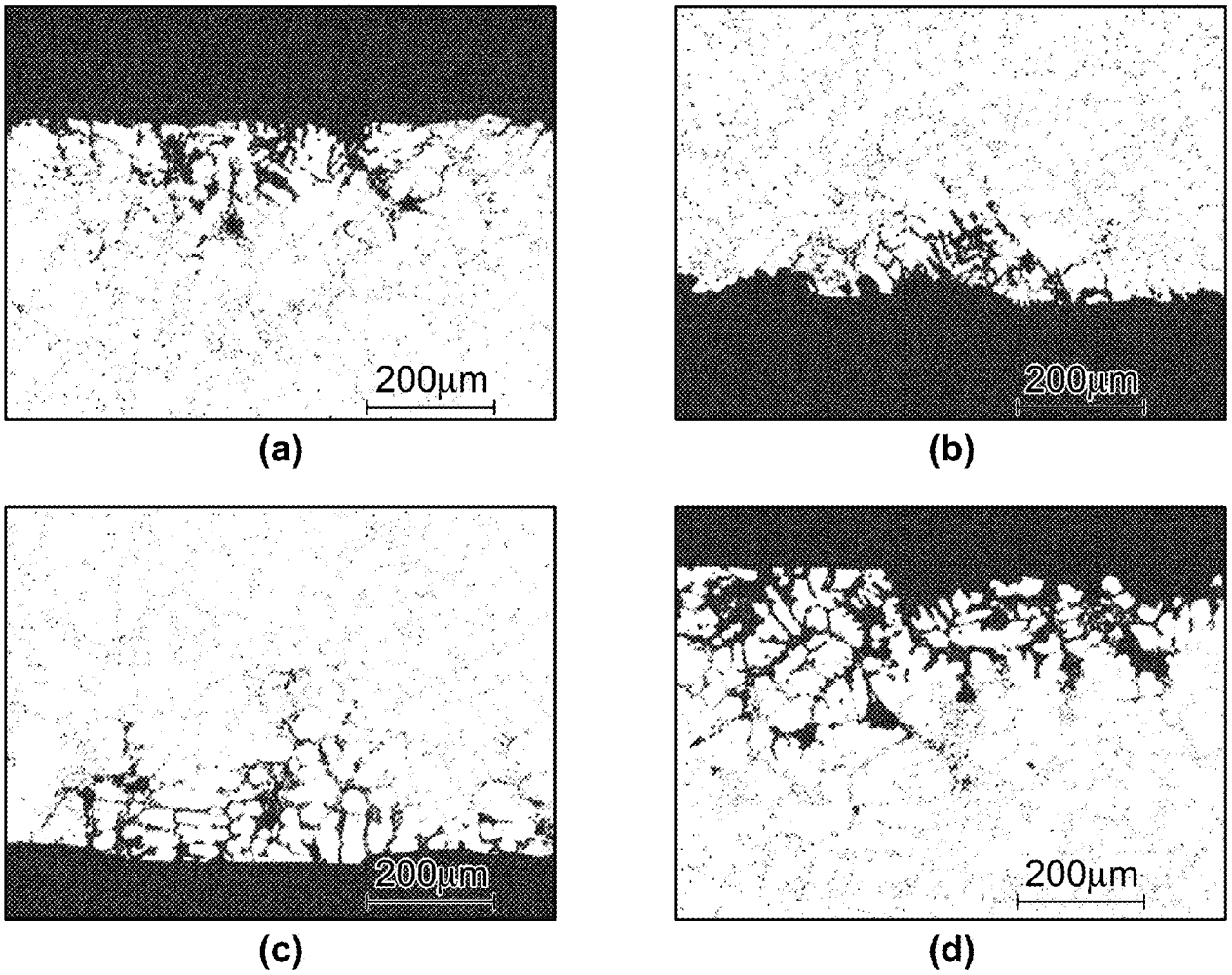
Figure 22:
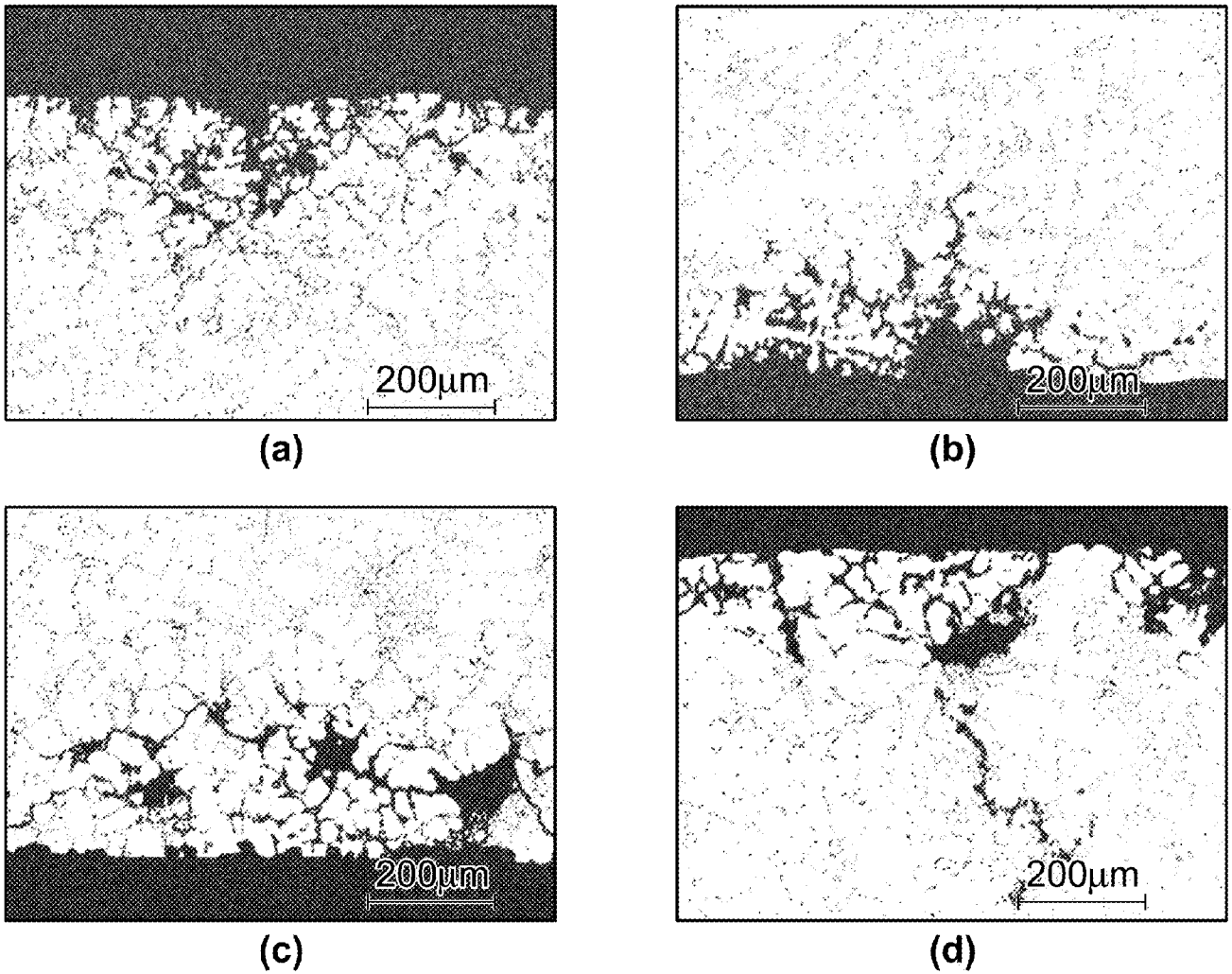
Figure 23:
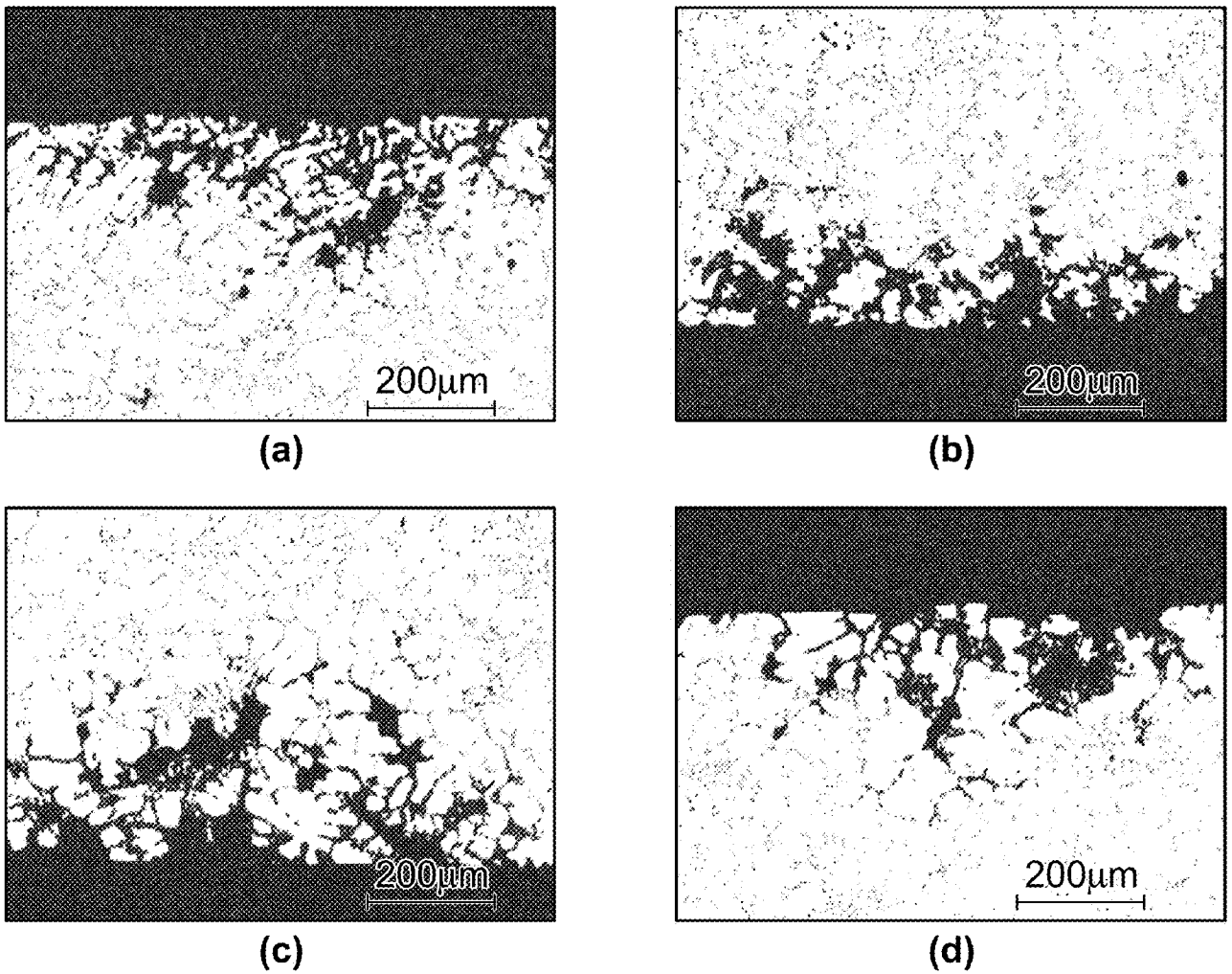

FIGS. 17 and 18 show the S—N fatigue test results of five selected alloys aged at 155° C. for 15 and 60 hours, respectively. During these tests a constant amplitude stress (R=−1) was applied to the test specimens. Three different stress levels, 100 MPa, 150 MPa and 200 MPa were applied. The total number of cycles to failure was recorded.

When aged at 155° C. for 15 hours, all the Cu-containing alloys showed better fatigue performance (higher number of cycles to failure) than the baseline A359 alloy at higher stress levels (>150 MPa). At lower stress levels (<125 MPa), the fatigue lives of the Al-9Si-0.45Mg-0.75Cu and Al-9Si-0.35Mg-1.75Cu alloys are very similar to the A359 alloy, while the fatigue life of the Al-9Si-0.45Cu-0.75Cu-4Zn alloy (alloy 3) was lower than the A359 alloy. The lower fatigue life of this alloy could result from the higher hydrogen content of the casting, as stated previously.

Increasing aging time (higher tensile strength) tended to decrease the number of cycles to failure. For example, as the aging time increased from 15 hours to 60 hours, the average number of cycles to failure at 150 MPa stress level decreased from ~323,000 to ~205,000 for the Al-9% Si-0.45% Mg-0.75% Cu alloy and from ~155,900 to ~82,500 for the A359 alloy. The result could be a general trend of the strength/fatigue relationship of Al—Si—Mg—(Cu) casting alloys. Again, alloy 3 showed a lower fatigue performance than others.

1.4.6 Corrosion Tests—ASTM G110

FIGS. 19 to 23 show optical micrographs of the cross-sectional views after 6-hour ASTM G110 tests for five selected alloys of both the as-cast surfaces and machined surfaces. The mode of corrosion attack was predominantly interdendritic corrosion. The number of corrosion sites was generally higher in the four Cu-containing compositions than in the Cu-free baseline alloy.

More particularly, FIGS. 19*a-d* show optical micrographs of cross-sections of Al-9% Si-0.5% Mg after a 6-hour ASTM G110 test: a) of the alloy as cast and aged 15 hours at 155° C.; b) of the alloy as cast and aged 60 hours at 155° C.; c) of the alloy with a machined surface and aged 15 hours at 155° C.; and d) of the alloy with a machined surface and aged 60 hours at 155° C.

FIGS. 20*a-d* show optical micrographs of cross-sections of Al-9% Si-0.35% Mg-0.75% Cu-4% Zn after a 6-hour ASTM G110 test: a) of the alloy as cast and aged 15 hours at 155° C.; b) of the alloy as cast and aged 60 hours at 155° C.; c) of the alloy with a machined surface and aged 15 hours at 155° C.; and d) of the alloy with a machined surface and aged 60 hours at 155° C.

FIGS. 21*a-d* show optical micrographs of cross-sections of Al-9% Si-0.45% Mg-0.75% Cu after a 6-hour ASTM G110 test: a) of the alloy as cast and aged 15 hours at 155° C.; b) of the alloy as cast and aged 60 hours at 155° C.; c) of the alloy with a machined surface and aged 15 hours at 155° C.; and d) of the alloy with a machined surface and aged 60 hours at 155° C.

FIGS. 22*a-d* show optical micrographs of cross-sections of Al-9% Si-0.45% Mg-1.25% Cu after a 6-hour ASTM G110 test: a) of the alloy as cast and aged 15 hours at 155° C.; b) of the alloy as cast and aged 60 hours at 155° C.; c) of the alloy with a machined surface and aged 15 hours at 155° C.; and d) of the alloy with a machined surface and aged 60 hours at 155° C.

FIGS. 23*a-d* show optical micrographs of cross-sections of Al-9% Si-0.35% Mg-1.75% Cu after a 6-hour ASTM G110 test: a) of the alloy as cast and aged 15 hours at 155° C.; b) of the alloy as cast and aged 60 hours at 155° C.; c) of the alloy with a machined surface and aged 15 hours at 155° C.; and d) of the alloy with a machined surface and aged 60 hours at 155° C.

Figure 24:
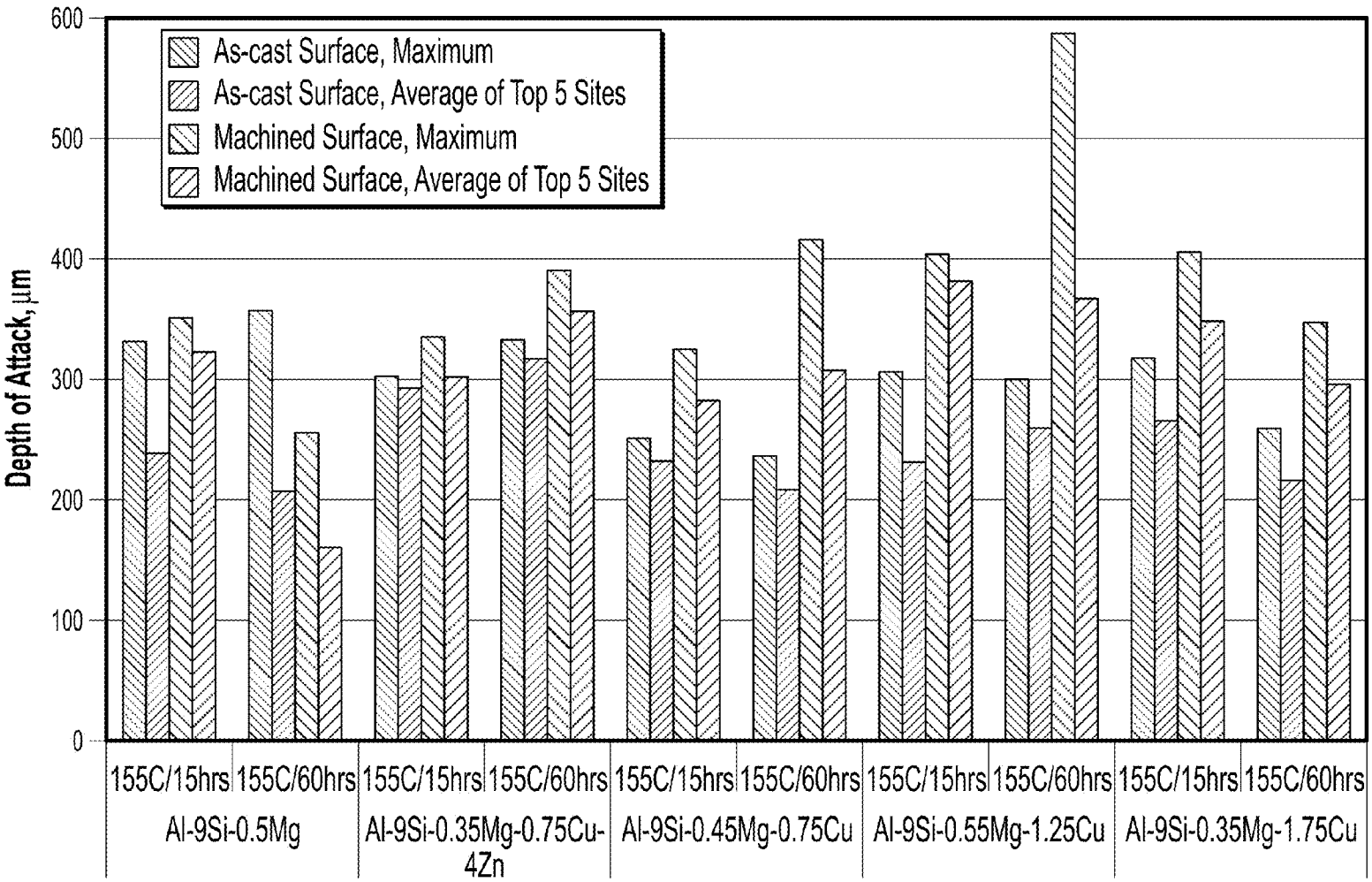
FIG. 24 is a graph of depth of attack of selected alloys aged for different time periods on the as-cast and machined surfaces after a 6-hour G110 test.

FIG. 24 shows the depth of attack after the 6-hour ASTM G110 test. There is no clear difference or trend among the alloys. Aging time did not show obvious impact on the depth of attack either, while some differences were found between the as-cast surfaces and the machined surfaces. In general, the corrosion attack was slightly deeper on the machined surface than the as-cast surface of the same sample.

Overall, the additions of Cu or Cu+Zn do not change the corrosion mode nor increase the depth-of-attack of the alloys. It is believed that all the alloys evaluated have similar corrosion resistance as the baseline alloy, A359.

The present disclosure has described Al—Si—Cu—Mg alloys that can achieve high strength without sacrificing ductility. Tensile properties including 450-470 MPa ultimate tensile strength, 360-390 MPa yield strength, 5-7% elongation, and 560-590 MPa Quality Index were obtained. These properties exceed conventional 3xx alloys and are very similar to that of the A201 (2xx+Ag) Alloy, while the castabilities of the new Al-9Si—MgCu alloys are much better than that of the A201 alloy. The new alloys showed better S—N fatigue resistance than A359 (Al-9Si-0.5Mg) alloys. Alloys in accordance with the present disclosure have adequate fracture toughness and general corrosion resistance.

EXAMPLE 2

Cast Alloys for Applications at Elevated Temperatures

Figure 26:
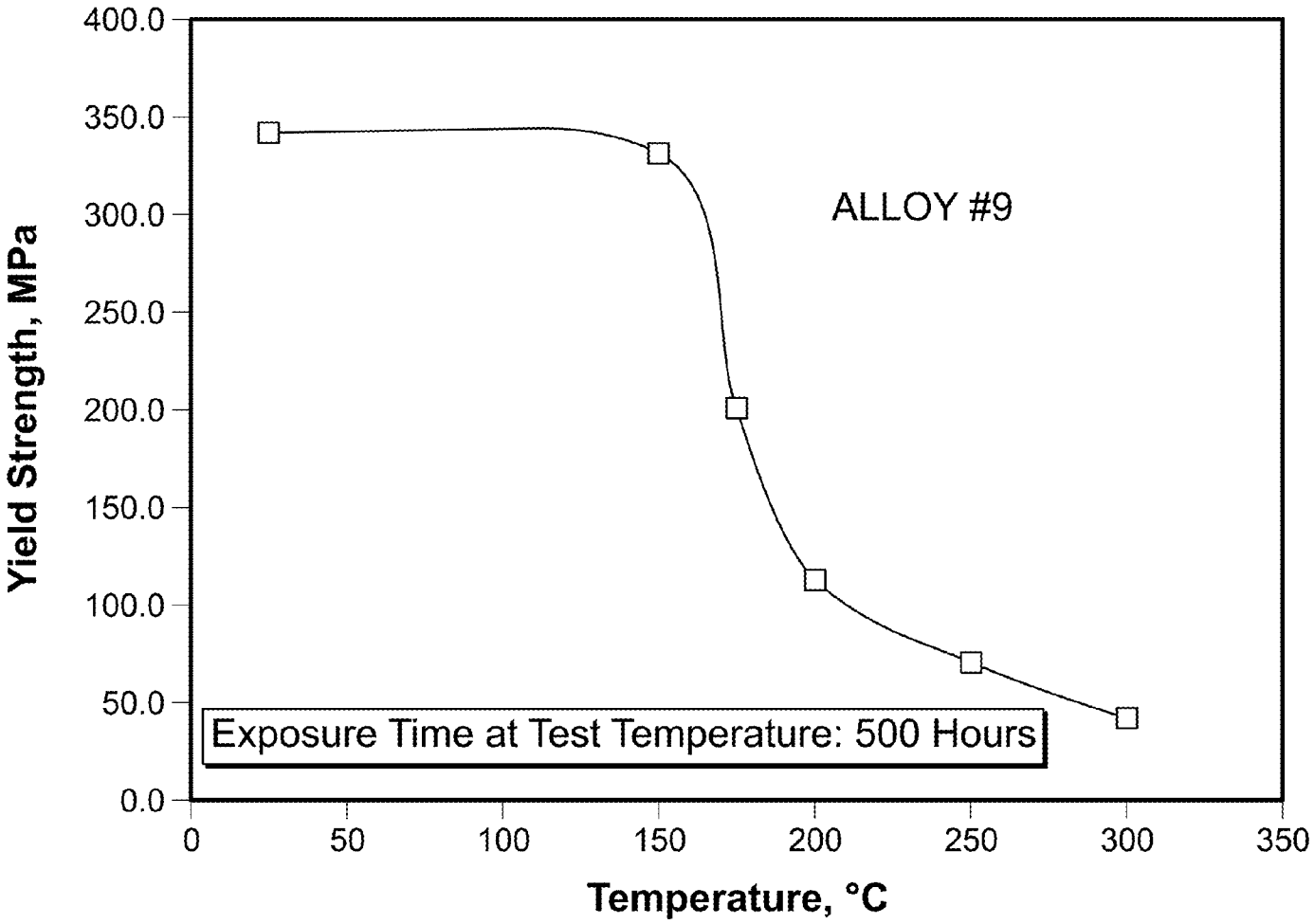
FIG. 26 is a graph of tensile properties of a specific alloy (alloy 9) after exposure to high temperatures.

Because alloys such as those described in the present disclosure may be utilized in applications wherein they are exposed to high temperatures, such as in engines in the form of engine blocks, cylinder heads, pistons, etc., it is of interest to assess how such alloys behave when exposed to high temperatures. FIG. 26 shows a graph of tensile properties of an alloy in accordance with the present disclosure, namely, Al-9Si-0.35Mg-1.75Cu (previously referred to as alloy 9, e.g., in FIG. 15) after exposure to various temperatures. As noted, for each test generating data in the graph, the exposure time of the alloys was 500 hours at the indicated temperature. The samples were also tested at the temperature indicated. As shown in the graph, the yield strength of the alloy diminished significantly at temperatures above 150° C. In accordance with the present disclosure, the metal was analyzed to ascertain features associated with the loss in strength due to exposure to increased temperatures.

Figure 27:
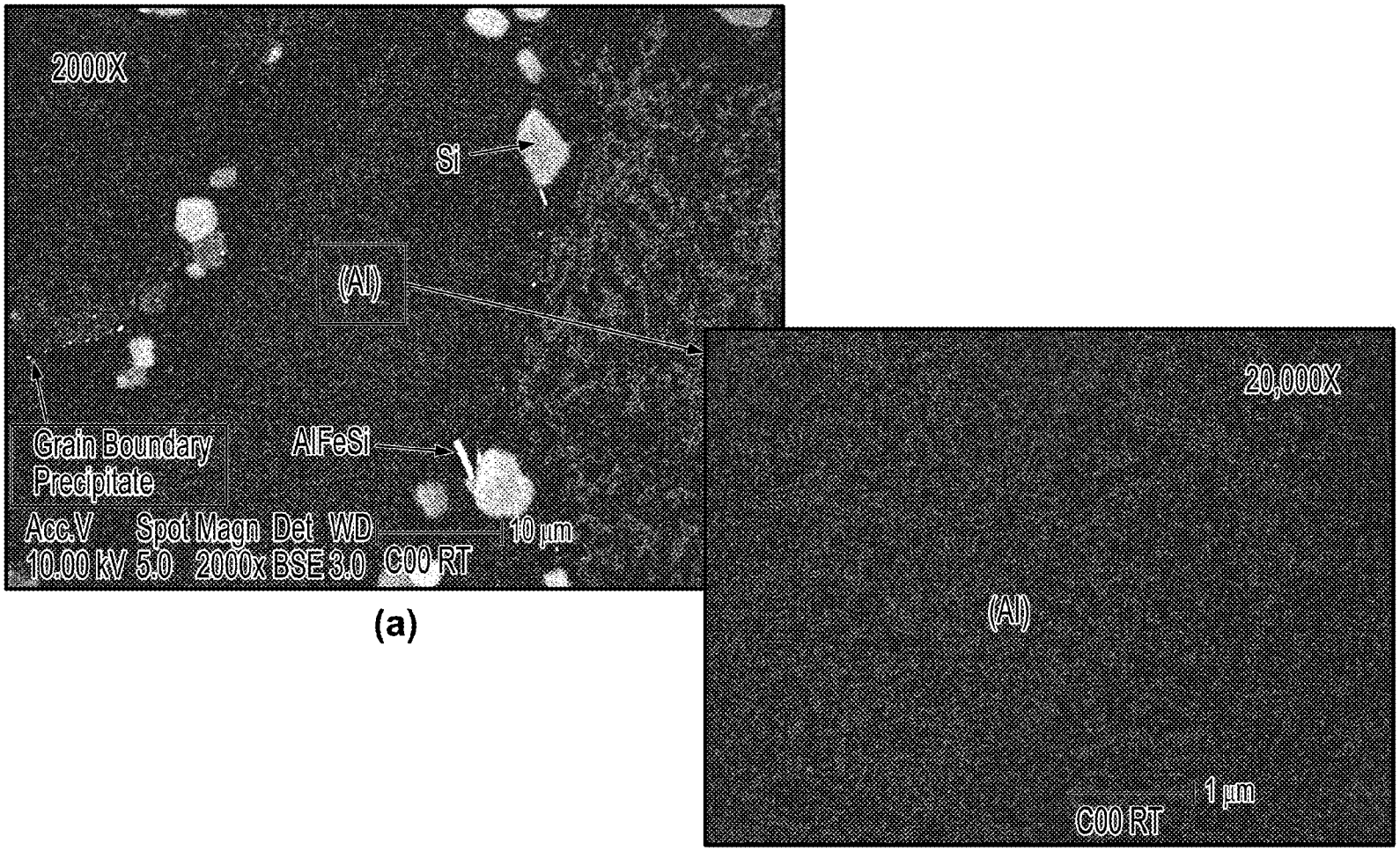
FIGS. 27*a* and 27*b* are scanning electron micrographs of a cross-section of a sample of alloy 9 prior to exposure to high temperatures.
Figure 28:
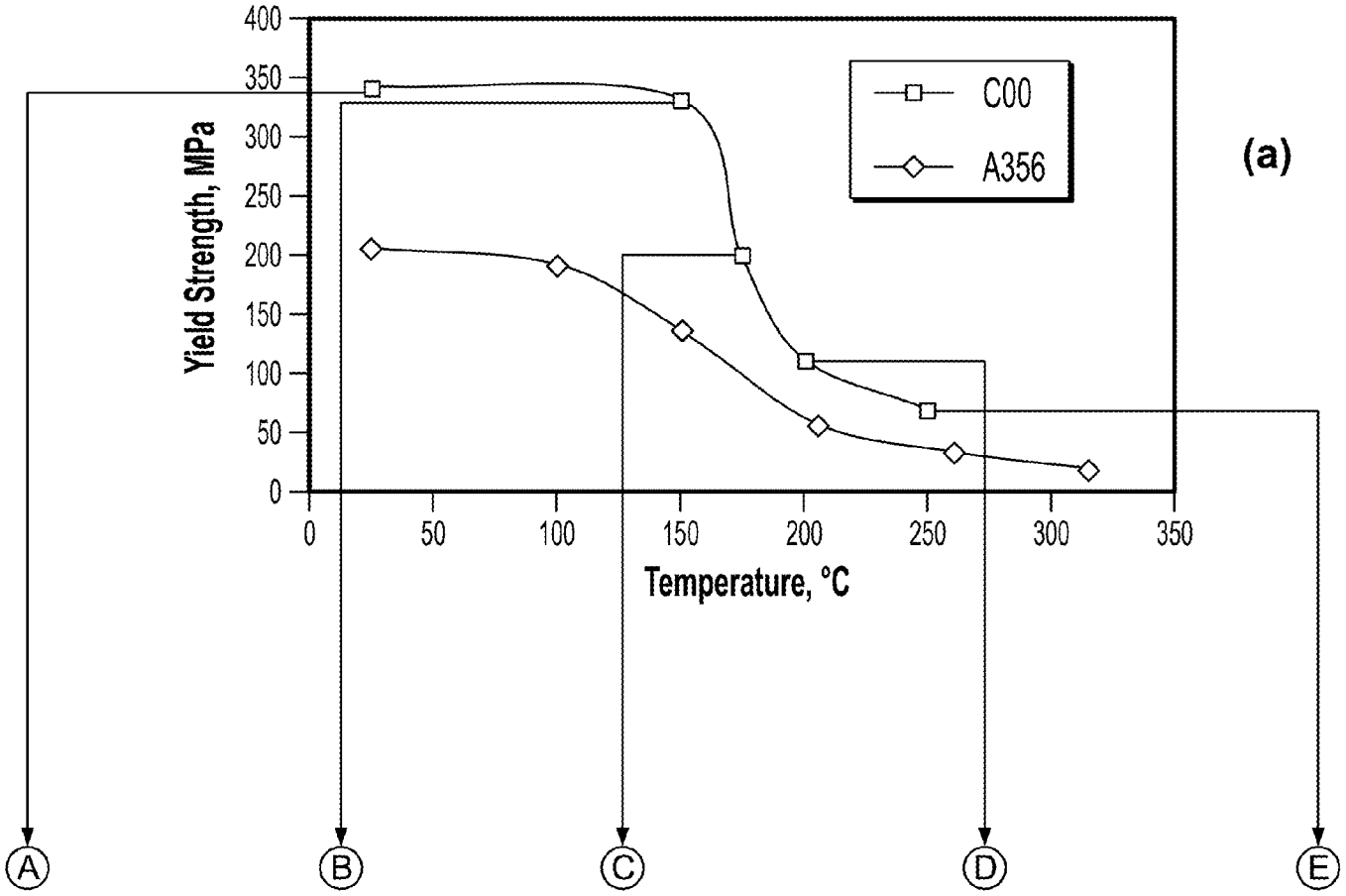
FIGS. 28*a-e* are a series of scanning electron micrographs of a cross-section of alloy 9 after exposure to increasing temperatures correlated to a tensile property graph of alloy 9 and A356 alloy.
Figure 28:
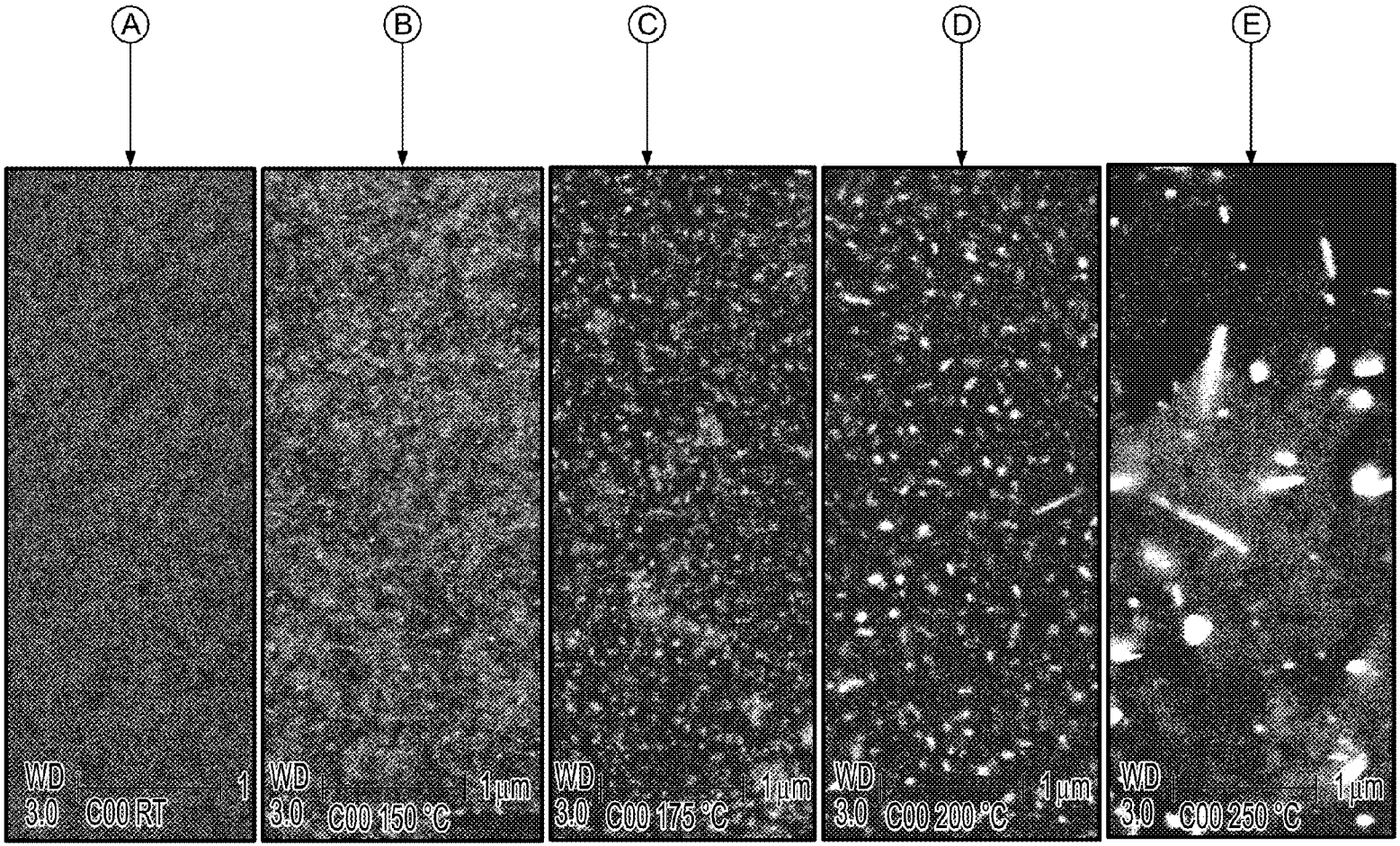

FIGS. 27*a* and 27*b* show scanning electron microscope (SEM) micrographs of a cross-section of a sample of alloy 9 prior to exposure to high temperatures, with 27*b* being an enlarged view of the portion of the micrograph of 31*a* indicated as "Al". As shown in FIG. 27*a*, the grain boundaries are visible, as well as, Si and AlFeSi particles. The predominately Al portion shown in FIG. 27*b* shows no visible precipitate at 20,000× magnification.

FIGS. 28*a-e* show a series of scanning electron microscope (SEM) micrographs of a cross-section of alloy C00 (previously referred to as alloy 9, e.g., in FIG. 15) of the same scale as the micrograph shown in FIG. 27*b* after exposure to increasing temperatures as shown by the correlation of the micrographs to the data points on the tensile property graph G of alloy 9. The tensile characteristics of A356 alloy in the given temperature range are also shown in graph G for comparison. As can be appreciated from the sequence of micrographs, exposure of alloy 9 to increasing temperatures results in continuously increasing prominence of precipitate particles, which are larger, and which exhibit divergent geometries.

The inventors of the present disclosure recognized that certain alloying elements, viz., Ti, V, Zr, Mn, Ni, Hf, and Fe could be introduced to the C00 alloy (previously referred to as alloy 9, e.g., in FIG. 15) of the present disclosure in small amounts to produce an alloy that resists strength degradation at elevated temperatures.

The following table (Table 10) show 18 alloys utilizing additive elements in small quantities to the C00 alloy (previously referred to as alloy 9, e.g., in FIG. 15) for the purpose of developing improved strength at elevated temperatures.

TABLE 10

| Alloy Compositions | | | | | | | | | | | | |
|---|---|---|---|---|---|---|---|---|---|---|---|---|
| | Actual Composition (wt %) | | | | | | | | | | | |
| Alloy | Fe | Si | Mn | Cu | Mg | Sr | Ti | B | V | Zr | Nl | Hf |
| C00 | 0.08 | 9.29 | 0 | 1.83 | 0.37 | 0.0125 | 0.05 | | 0 | 0 | 0 | 0 |
| C01 | 0.15 | 9.3 | 0.002 | 1.82 | 0.002 | 0.008 | 0.11 | 0.0047 | 0.012 | 0.002 | 0 | 0 |

TABLE 10-continued

| Alloy Compositions | | | | | | | | | | | | |
|---|---|---|---|---|---|---|---|---|---|---|---|---|
| | Actual Composition (wt %) | | | | | | | | | | | |
| Alloy | Fe | Si | Mn | Cu | Mg | Sr | Ti | B | V | Zr | Nl | Hf |
| C02 | 0.15 | 9.35 | 0.002 | 1.82 | 0.39 | 0.008 | 0.11 | 0.0043 | 0.012 | 0.002 | 0 | 0 |
| C03 | 0.15 | 9.05 | 0.002 | 1.77 | 0.37 | 0.007 | 0.11 | 0.0051 | 0.13 | 0.002 | 0 | 0 |
| C04 | 0.16 | 8.95 | 0.002 | 1.77 | 0.36 | 0.006 | 0.1 | 0.0026 | 0.1 | 0.091 | 0 | 0 |
| C05 | 0.16 | 8.86 | 0.002 | 1.76 | 0.36 | 0.005 | 0.1 | 0.0016 | 0.13 | 0.15 | 0 | 0 |
| C06 | 0.16 | 8.54 | 0.002 | 1.72 | 0.35 | 0.004 | 0.1 | 0.005 | 0.13 | 0.18 | 0 | 0 |
| C07 | 0.16 | 9.31 | 0.15 | 1.8 | 0.34 | 0.004 | 0.11 | 0.0044 | 0.025 | 0.016 | 0 | 0 |
| C08 | 0.16 | 9.32 | 0.16 | 1.84 | 0.34 | 0.004 | 0.11 | 0.0051 | 0.025 | 0.017 | 0 | 0 |
| C09 | 0.17 | 9.1 | 0.28 | 1.8 | 0.33 | 0.003 | 0.11 | 0.005 | 0.025 | 0.016 | 0 | 0 |
| C10 | 0.32 | 9.26 | 0.3 | 1.83 | 0.34 | 0.003 | 0.11 | 0.0045 | 0.024 | 0.017 | 0 | 0 |
| C11 | 0.49 | 8.96 | 0.3 | 1.78 | 0.32 | 0.003 | 0.12 | 0.0055 | 0.11 | 0.016 | 0 | 0 |
| C12 | 0.56 | 8.97 | 0.3 | 1.79 | 0.32 | 0.002 | 0.1 | 0.0039 | 0.11 | 0.12 | 0 | 0 |
| C13 | 0.15 | 9.28 | 0.003 | 1.82 | 0.33 | 0.0125 | 0.1 | 0.005 | 0.0012 | 0.002 | 0.28 | 0 |
| C14 | 0.2 | 9.28 | 0.004 | 1.81 | 0.33 | 0.004 | 0.1 | 0.0026 | 0.012 | 0.002 | 0.28 | 0 |
| C15 | 0.31 | 9.27 | 0.03 | 1.82 | 0.33 | 0.004 | 0.1 | 0.0032 | 0.012 | 0.002 | 0.28 | 0 |
| C16 | 0.32 | 9.14 | 0.1 | 1.79 | 0.32 | 0.003 | 0.1 | 0.0032 | 0.012 | 0.003 | 0.27 | 0.1 |
| C17 | 0.32 | 8.88 | 0.12 | 1.75 | 0.3 | 0.003 | 0.1 | 0.0031 | 0.11 | 0.013 | 0.26 | 0.1 |
| C18 | 0.32 | 8.89 | 0.14 | 1.76 | 0.3 | 0.003 | 0.1 | 0.003 | 0.11 | 0.036 | 0.27 | 0.1 |

Table 11 shows the mechanical properties of the foregoing alloys, viz., ultimate tensile strength (UTS), total yield strength (TYS) and Elongation % at 300° C., 175° C. and room temperature (RT).

TABLE 11

| Mechanical Properties at Various Temperatures | | | | | | | | | |
|---|---|---|---|---|---|---|---|---|---|
| | 300 C. | | | | | | | | |
| Alloy | UTS(ksi | | | TYS(ksi) | | | Elongation(%) | | |
| C00 | 8.2 | 8.4 | 8.3 | 6 | 6.3 | 6 | 49 | 54 | 29.5 |
| C01 | 9.3 | 9.5 | 9.6 | 6.5 | 6.4 | 6.7 | 63 | 54.5 | 49.5 |
| C02 | 10 | 10.3 | 9 | 6.9 | 7.2 | 6.5 | 51.5 | 40.5 | 40.5 |
| C03 | 8.8 | 10.2 | 10.6 | 6.8 | 7.2 | 7.5 | 52 | 43.5 | 56.5 |
| C04 | 10.4 | 10.3 | 11.7 | 7.9 | 7.4 | 8 | 47.5 | 47 | 41.5 |
| C05 | 10.8 | 10.7 | 11.1 | 8.5 | 8 | 8.2 | 47 | 41.5 | 36.5 |
| C06 | 11 | 9.3 | 11.2 | 7.7 | 7.1 | 8.5 | 35 | 36 | 42.5 |
| C07 | 10.5 | 10.6 | 10.3 | 8.1 | 8 | 7.7 | 53 | 40 | 43.5 |
| C08 | 10 | 9.7 | 10.6 | 7.5 | 6.7 | 7.9 | 39 | 40.5 | 36.5 |
| C09 | 10.3 | 10.8 | 11.7 | 7.5 | 7.8 | 8.6 | 35 | 35 | 36 |
| C10 | 10.7 | 10.7 | 11.3 | 8.1 | 8 | 8.3 | 37 | 40 | 33 |
| C11 | 11 | 11.3 | 10.5 | 7.9 | 8.1 | 7.7 | 27.5 | 30.5 | 34.5 |
| C12 | 11.7 | 10.8 | 11.4 | 8.2 | 7.9 | 8.2 | 33 | 28.5 | 34.5 |
| C13 | 10.2 | 9 | 9.4 | 7.5 | 6.9 | 7 | 45.5 | 53 | 40 |
| C14 | 9.3 | 9.2 | 9.9 | 6.6 | 6.6 | 6.9 | 56 | 44 | 42.5 |
| C15 | 10 | 9.8 | 10 | 7.2 | 7.2 | 7.2 | 46.5 | 32 | 31.5 |
| C16 | 10.3 | 10.3 | 10.1 | 7.7 | 7.5 | 7.5 | 44.5 | 36.5 | 34.5 |
| C17 | 10.5 | 9.4 | 10 | 7.5 | 7.2 | 7.2 | 46.5 | 42.5 | 29.5 |
| C18 | 10.1 | 11.4 | 11.3 | 7.5 | 8.6 | 8.2 | 29 | 28.5 | 25.5 |

| | 175 C. | | | | | | | | | RT | | | | | |
|---|---|---|---|---|---|---|---|---|---|---|---|---|---|---|---|
| Alloy | UTS(ksi | | | TYS(ksi) | | | Elongation(%) | | | UTS(ksi | | TYS(ksi) | | Elongation(%) | |
| C00 | 34.8 | 33.7 | 37.1 | 28.8 | 27.8 | 31 | 8.5 | 10.5 | 10.5 | 58.4 | 56.5 | 47.7 | 52.4 | 4 | 4 |
| C01 | 28.1 | 31 | 29.4 | 21.4 | 23.7 | 21.8 | 16.6 | 24 | 14.9 | 37.7 | 38.4 | 20.1 | 20.9 | 9 | 12 |
| C02 | 43.6 | 46.2 | 46.1 | 38 | 39.6 | 40.2 | 6.9 | 5.1 | 5.1 | 60.2 | 56.7 | | 46.2 | 3 | 3 |
| C03 | 44.9 | 43.1 | 45.4 | 40.6 | 37.4 | 39.8 | 0.6 | 7.4 | 4 | 50.5 | 59.8 | 48.7 | 50.3 | 3 | 5.5 |
| C04 | 46.5 | 46.5 | 48.3 | 40.6 | 41 | 42.8 | 6.9 | 9.1 | 4.6 | 58.7 | 57.5 | 49.7 | 48.1 | 3 | 1 |
| C05 | 40 | 47.4 | 47 | 35.4 | 40.7 | 39.9 | 2.9 | 5.1 | 5.1 | 52.4 | 58.2 | 51.1 | 47.7 | 1 | 3 |
| C06 | 44.3 | 43.6 | 46.6 | 38.4 | 37.4 | 40.9 | 5.7 | 8 | 3.4 | 57.9 | 59.1 | 48.2 | 48.8 | 3 | 4 |
| C07 | 48.3 | 46.7 | 43 | 41.6 | 40.8 | 38 | 6.3 | 2.3 | 6.9 | 57 | 58.3 | 48.1 | | 3.5 | 3.5 |
| C08 | 49.3 | 41.8 | 42.6 | 41.2 | 36.5 | 36.6 | 6.3 | 2.3 | 6.9 | 58.6 | 52 | 46.2 | 48.2 | 3.5 | 3 |
| C09 | 39 | 45.2 | 43.9 | 33.7 | 39.2 | 38.6 | 3.4 | 3.4 | 2.3 | 52 | 58.1 | 47.9 | 48.5 | 3 | 3 |
| C10 | 35.7 | 43.6 | 48.6 | 30.9 | 37.3 | 41.9 | 2.3 | 3.4 | 2.3 | 55 | 55.6 | 47.7 | 49.6 | 3 | 3 |
| C11 | 42.4 | 42.5 | 47.6 | 36.5 | 35.8 | 41.1 | 1.1 | 2.3 | 2.3 | 54.1 | 52.6 | 49.3 | 49.1 | 3 | 3 |
| C12 | 37.9 | 37.3 | 37.3 | 35.3 | 31.7 | 31.2 | 1.1 | 1.7 | 4 | 50.2 | 52.7 | 48.5 | 50.6 | 1 | 1.5 |
| C13 | 45.3 | 45.2 | 41.3 | 39.2 | 38.2 | 35 | 2.9 | 6.3 | 8 | 56.3 | 58.5 | 48.1 | 45.9 | 2.5 | 8 |
| C14 | 34.3 | 38.6 | 45.7 | 32.3 | 32.4 | 39 | 0.6 | 9.1 | 5.1 | 61.3 | 57.1 | 44.3 | 44.5 | 8 | 4 |
| C15 | 40.1 | 45.2 | 44.7 | 34.2 | 38.5 | 37.6 | 2.9 | 5.1 | 3.4 | 56.7 | 55.8 | 45.9 | 47.1 | 4 | 4 |

TABLE 11-continued

| Mechanical Properties at Various Temperatures | | | | | | | | | | | | | | | |
|---|---|---|---|---|---|---|---|---|---|---|---|---|---|---|---|
| C16 | 42.3 | 41.6 | 41.7 | 35.4 | 35.2 | 35.9 | 4 | 5.1 | 2.3 | 57.4 | 53.7 | 46.4 | 46 | 4 | 3 |
| C17 | 42.6 | 38.4 | 39.5 | 21.8 | 38 | 34.2 | 14.9 | 6.9 | 2.3 | 57.2 | 56.1 | 47.1 | 46.9 | 3 | 3 |
| C18 | 37.2 | 41.4 | 41.5 | 35.1 | 34.6 | 34.7 | 1.1 | 5.1 | 3.4 | 48.5 | 50.6 | 45.1 | 46.9 | 2 | 2 |

Figure 29:
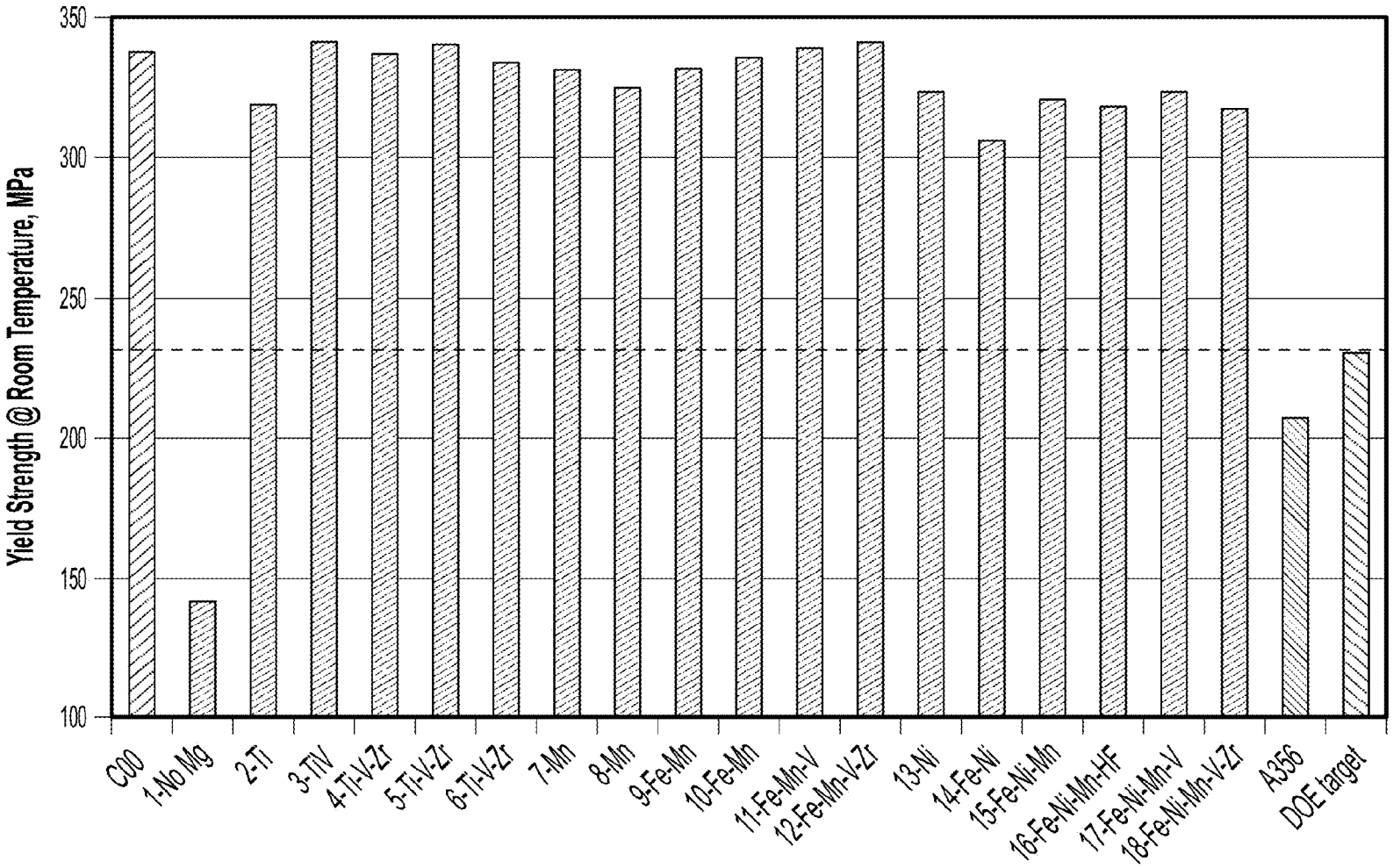
FIG. 29 is a graph of yield strength at room temperature for various alloys.

FIG. 29 shows a graph of yield strength at room temperature for foregoing alloys. A356 is shown for comparison. In addition, a department of energy (DOE) published target for strength improvement is shown for comparison [Predictive Modeling for Automotive Light weighting Applications and Advanced Alloy Development for Automotive and Heavy-Duty Engines, Issue by Department of Energy on Mar. 22, 2012]. As can be appreciated, the C00 alloy is comparable in strength at room temperature to alloys C02-C18, all of which substantially exceed the strength of the A356 alloy and the DOE target properties. Alloy C01—without substantial quantities of Mg, has a far lower yield strength.

Figure 30:
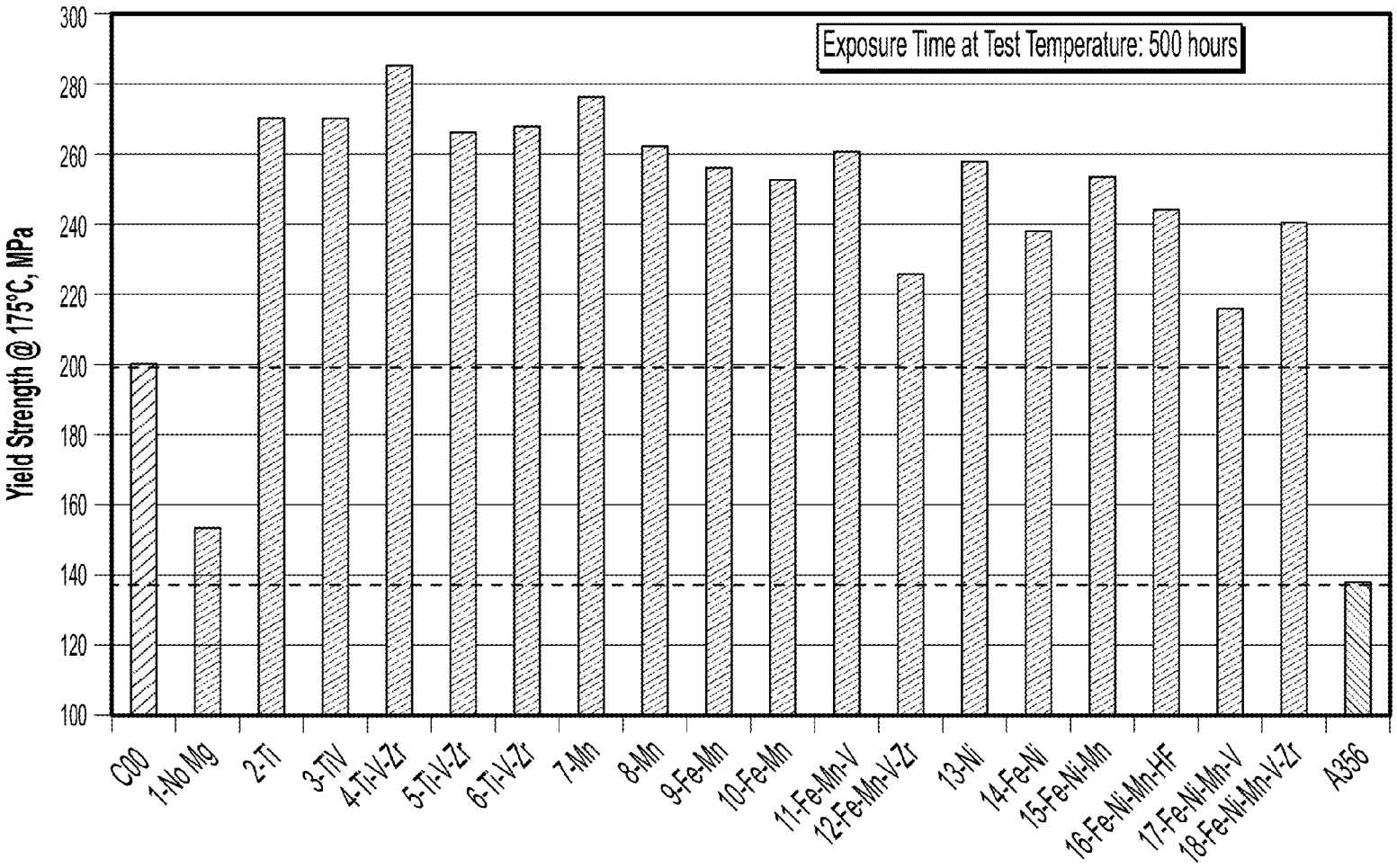
FIG. 30 is a graph of yield strength after exposure to 175° C. for various alloys.

FIG. 30 is a graph of yield strength after exposure to 175° C. for 500 hours for the foregoing alloys. The C00, as well as A356 are shown for comparison. As can be appreciated, the C00 alloy substantially exceeds the strength of the A356 alloy. Alloys C02-C18), all show marked improvement over both A356 and C00.

Figure 31:
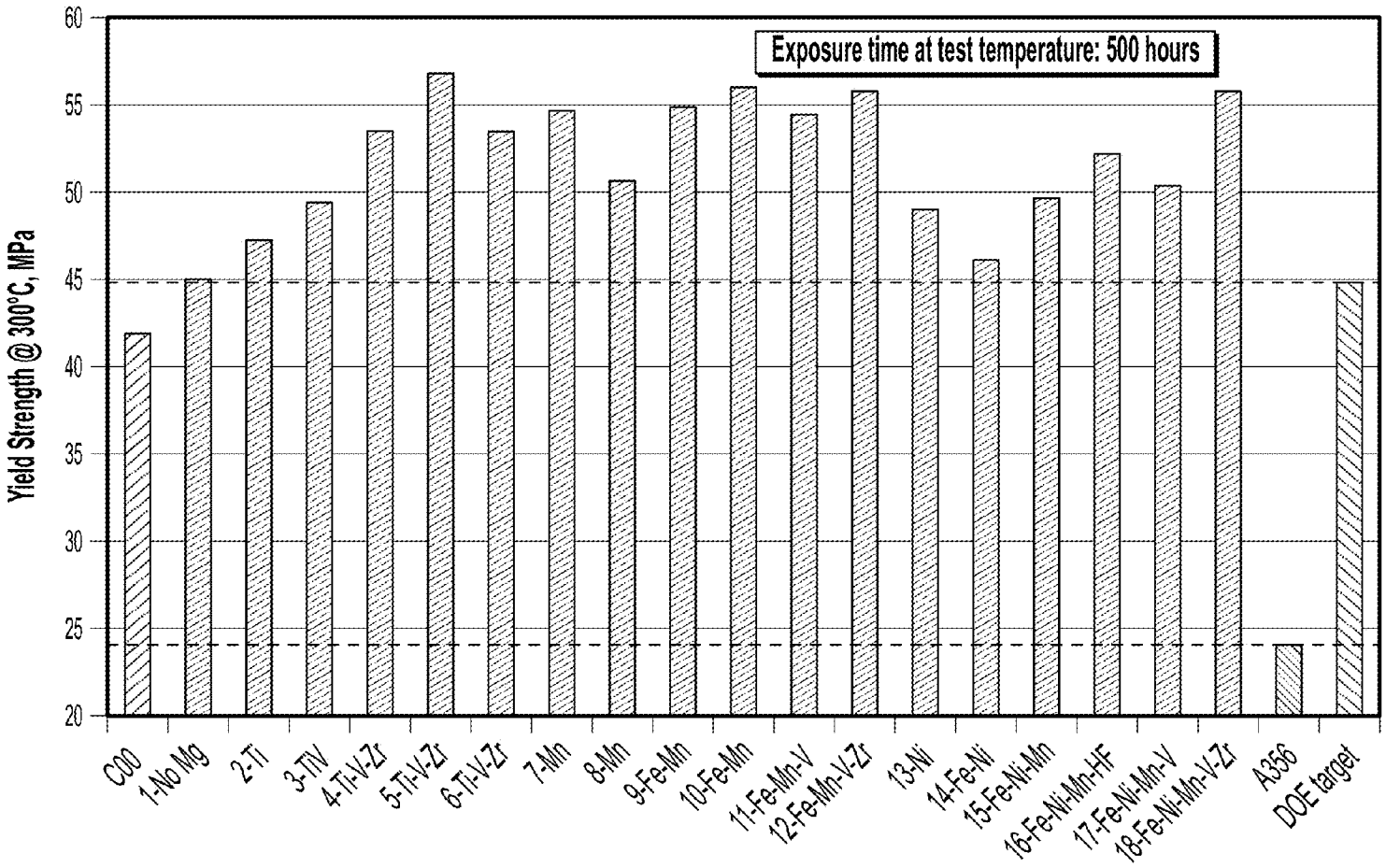
FIG. 31 is a graph of yield strength after exposure to 300° C. for various alloys.
Figure 32:
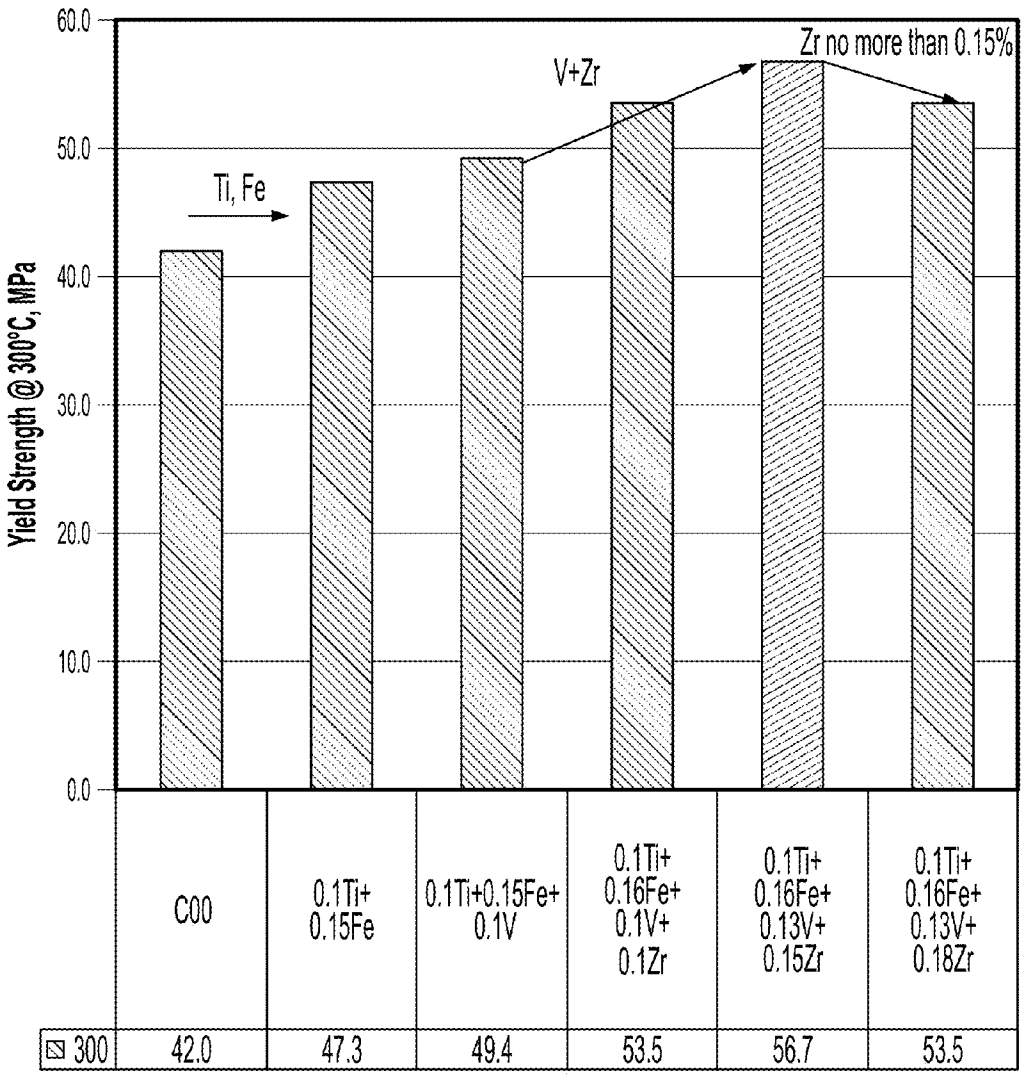
FIG. 32 is a graph of yield strength after exposure to 300° C. for various alloys.

FIG. 31 is a graph of yield strength after exposure to 300° C. for 500 hours for the foregoing alloys. C00, as well as A356 are shown for comparison. FIG. 32 shows is a graph of yield strength after exposure to 300° C. for various alloys. More particularly, adjacent alloys (going in the direction of the arrows) show the result of an additional element or the increase in quantity of an element. The highest result in the graph of FIG. 32 is for C00+0.1T+0.16Fe+0.13V+0.15Zr. The addition of more Zr (to 0.18%) to this combination results in decreased performance.

Figure 33:
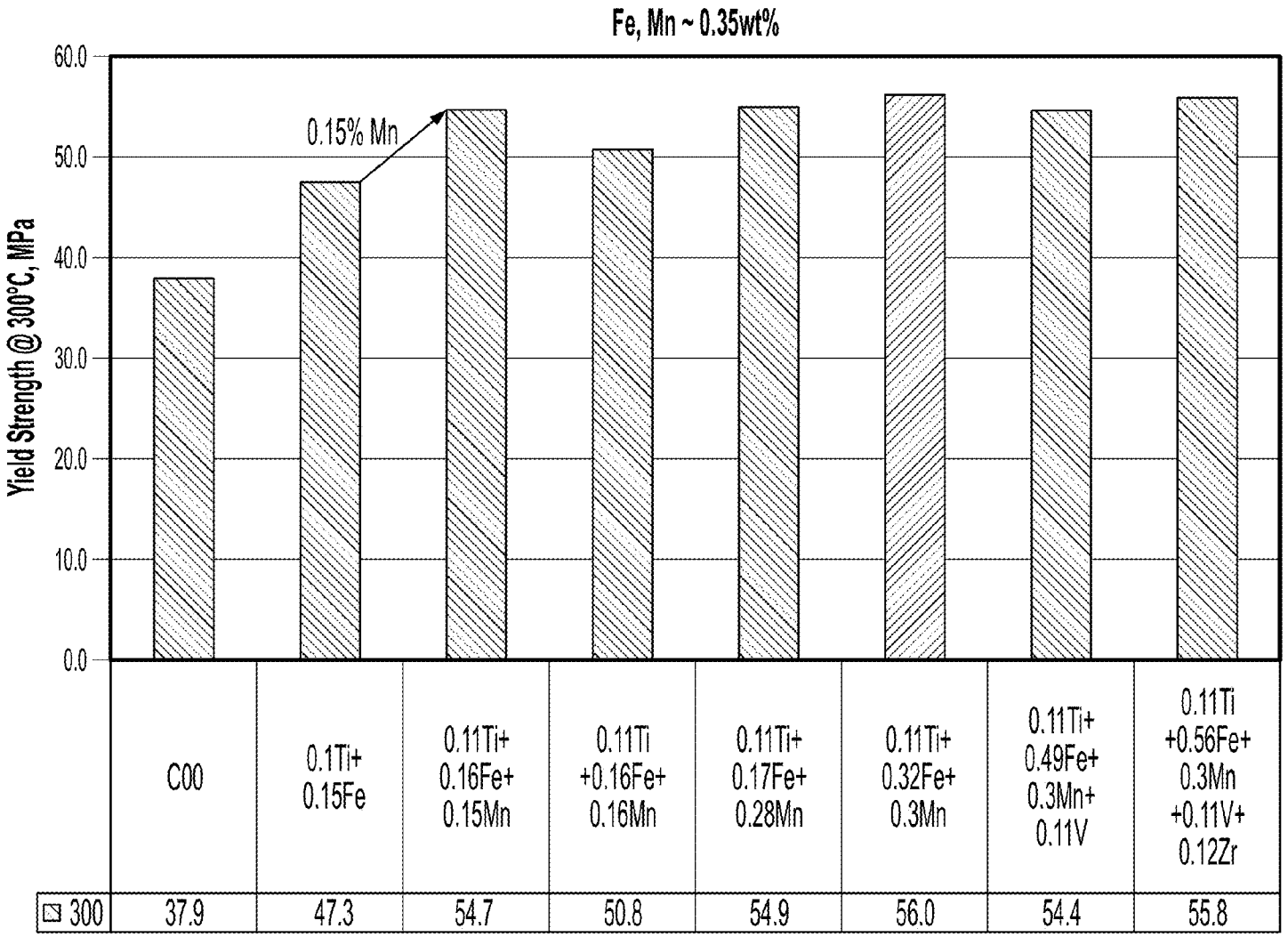
FIG. 33 is a graph of yield strength after exposure to 300° C. for various alloys.

FIG. 33 is a graph of yield strength after exposure to 300° C. for various alloys for 500 hours. The graphs show improvements due to the addition of Ti, Fe and Mn to the C00 composition, with the maximum performance noted relative to C00+0.11Ti+0.32Fe+0.3Mn. The addition of V to the foregoing reduces performance and the further addition of 0.12Zr brings performance almost back to the maximum level.

Figure 34:
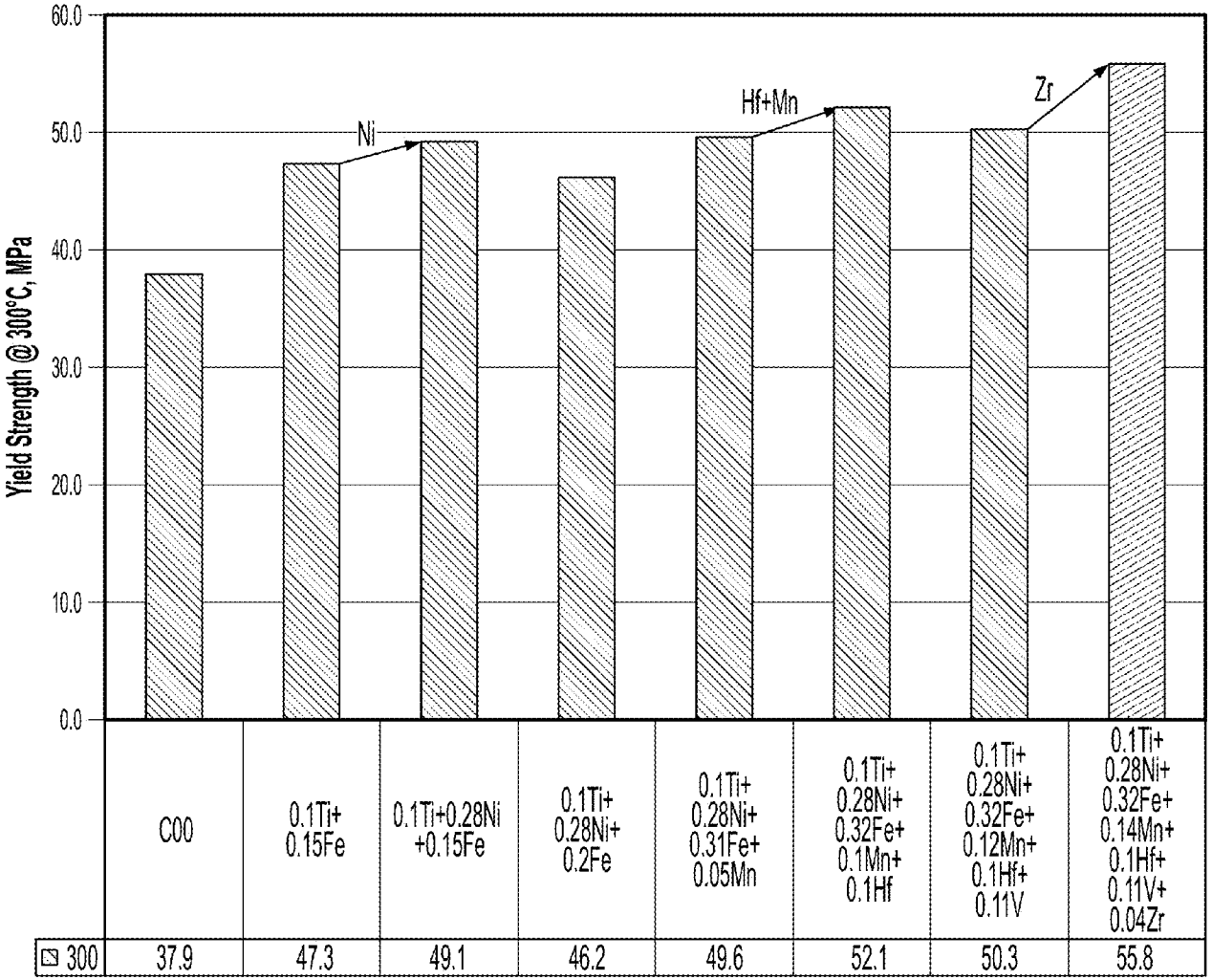
FIG. 34 is a graph of yield strength after exposure to 300° C. for various alloys.

FIG. 34 is a graph of yield strength after exposure to 300° C. for various alloys, i.e., due to the addition of elements to the C00 composition. The optimal performance is noted relative to C00+0.1Ti+0.28Ni+0.32 Fe+0.14Mn+0.1Hf+0.11V+0.04Zr.

It will be understood that the embodiments described herein are merely exemplary and that a person skilled in the art may make many variations and modifications without departing from the spirit and scope of the claimed subject matter. For example, use different aging conditions may produce different resultant characteristics. All such variations and modifications are intended to be included within the scope of the appended claims.

We claim:

1. A cast aluminum part made from an aluminum casting alloy consisting of:

8. 5-9.5 wt. % silicon;

1. 35-2.0 wt. % copper (Cu);

0. 27-0.445 wt. % magnesium (Mg);

wherein the aluminum casting alloy includes copper and magnesium such that 4.7≤(Cu+10Mg) ≤5.8;

0 wt. % zinc;

up to 0.01 wt. % silver;

up to 1.0 wt. % nickel;

up to 1.0 wt. % hafnium;

0. 14-0.3 wt. % manganese 0.08-0.33 wt. % iron 0.05-0.12 wt. % titanium;

0. 08-0.19 wt. % zirconium;

0. 1-0.14 wt. % vanadium;

up to 0.10 wt. % of one or more of strontium, sodium and antimony;

other elements being ≤0.04 wt. % each and ≤0.12 wt. % in total; and the balance being aluminum;

wherein the cast aluminum part contains spherodized silicon particles;

wherein the cast aluminum part contains a sufficient amount of the Cu and the Mg to form Q phase precipitates;

wherein the cast aluminum part contains a sufficient amount of the Cu and the Mg such that the cast aluminum part is free of undissolved Q phase constituent particles;

wherein the amount of undissolved Q phase constituent particles is determined by using the following test method:

(a) heating the cast aluminum part to 10° C. below the solidus temperature of the cast aluminum part for at least 2 hours; and (b) using SEM to view the microstructure of the cast aluminum part;

wherein, when cast in the form of an ASTM B108 tensile-bar casting, the aluminum casting alloy realizes:

(i) an ultimate tensile strength of from 450 to 480 MPa;

(ii) a first tensile yield strength of from 360 to 390 MPa;

(iii) an elongation of from 5 to 9%;

(iv) a quality index of from 560 to 610 MPa; and (v) a second tensile yield strength of from 50.8 to 56.7 MPa;

wherein properties (i)-(iv) are tested at room temperature and after the ASTM B108 tensile-bar casting has been artificially aged at 155° C. for 15 to 60 hours; and wherein property (v) is tested at 300° C. after the ASTM B108 tensile-bar casting has been exposed to a temperature of 300° C. for 500 hours.

2. The cast aluminum part of claim 1, wherein the aluminum casting alloy includes copper and magnesium such that 5.0≤(Cu+10Mg)≤5.5.

3. The cast aluminum part of claim 1, wherein the aluminum casting alloy includes copper and magnesium such that 5.1≤(Cu+10Mg)≤5.4.

4. The cast aluminum part of claim 1, wherein the aluminum casting alloy includes 0.1-0.12 wt. % titanium.

5. The cast aluminum part of claim 4, wherein the aluminum casting alloy includes 0.1-0.12 wt. % vanadium.

6. The cast aluminum part of claim 4, wherein the aluminum casting alloy includes 0.11-0.13 wt. % zirconium.

7. The cast aluminum part of claim 1, wherein the aluminum casting alloy includes 0 wt. % nickel.

8. The cast aluminum part of claim 7, wherein the cast aluminum part is one of an engine block, a cylinder head, and a piston.

9. The cast aluminum part of claim 1, wherein the cast aluminum part contains undissolved iron-containing particles.

10. The cast aluminum part of claim 1, wherein the aluminum casting alloy includes at least 1.72 wt. % Cu.

* * * * *